US006629744B2

(12) United States Patent
Otsuki

(10) Patent No.: US 6,629,744 B2
(45) Date of Patent: Oct. 7, 2003

(54) PRINTING BY SWITCHING SUB-SCAN FEEDING BETWEEN MONOCHROMATIC AND COLOR AREAS

(75) Inventor: Koichi Otsuki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/147,916

(22) Filed: May 20, 2002

(65) Prior Publication Data

US 2002/0175962 A1 Nov. 28, 2002

(30) Foreign Application Priority Data

May 23, 2001 (JP) ..... 2001-154235

(51) Int. Cl.[7] ..... B41J 2/205
(52) U.S. Cl. ..... 347/15; 347/43; 347/41
(58) Field of Search ..... 347/15, 43, 41, 347/16, 12, 40

(56) References Cited

U.S. PATENT DOCUMENTS 5,600,353 A 2/1997 Hickman et al.
5,692,843 A 12/1997 Furuya
6,062,674 A * 5/2000 Inui et al. ..... 347/43
6,164,756 A 12/2000 Takahashi et al.
6,209,987 B1 4/2001 Katayama
6,486,981 B1 * 11/2002 Shimura et al. ..... 358/500

FOREIGN PATENT DOCUMENTS

JP 08-238805 9/1996
JP 08-244256 9/1996
JP 10-337892 12/1998

OTHER PUBLICATIONS

Japanese Abstract No. 10129011, dated May 19, 1998.
Japanese Abstract No. 06219041, dated Aug. 9, 1994.

* cited by examiner

*Primary Examiner*—Lamson Nguyen
(74) *Attorney, Agent, or Firm*—Sughrue Mion, PLLC

(57) ABSTRACT

Efficient printing of data containing two types of areas (color and monochromatic) in the direction of sub-scanning is present. Routine feeding is performed in 15-dots feed increments while dots are recorded using black nozzle Nos. 1 to 15 during routine monochromatic mode printing (step S2). Minor-feeding is then performed in 3-dot feed increments while the same type of main scanning is carried out in the course of lower-edge monochromatic mode printing (step S4). A position adjusting feed may be optionally performed (steps S6, S8). Five nozzles each for cyan, magenta, and yellow are used, and black nozzle Nos. 11 to 15 are used during upper-edge color mode printing (step S10). Minor-feeding is performed in single-dot feed increments. Routine feeding is then performed in 5-dot feed increments while the same type of main scanning is carried out in the course of routine color mode printing (step S12).

54 Claims, 16 Drawing Sheets

PRINTING BY SWITCHING SUB-SCAN FEEDING BETWEEN MONOCHROMATIC AND COLOR AREAS

BACK GROUND OF THE INVENTION

1. Field of the Invention

The present invention relates to technology for printing by forming dots on a printing medium while performing a main scan, and specifically relates to technology for printing images for which there are two types of areas, color areas and monochromatic areas, in the sub-scan direction.

2. Description of the Related Art

In recent years, as computer output devices, there has been a broad popularization of color printers of the type that eject several colors of ink from a head. Among this type of color printer, there are printers that print an image by forming dots on a printing medium by ejecting ink drops from a nozzle while performing a main scan.

Also, there are printing devices that are equipped with a higher number of nozzles that eject only black ink than those for other colored inks. For that kind of printing device, when printing color data, color printing is done using the same number of nozzles for each color. Only the same number of nozzles as the number of nozzles for each color is used for the black nozzles. Then, when printing data represent a monochromatic image, the monochromatic printing is performed at high speed using all of the black nozzles.

However, with the printing device noted above, when within the printed image there are two types of areas, monochromatic areas that use only black ink, and color areas, there is the problem that printing cannot be performed efficiently.

SUMMARY OF THE INVENTION

Accordingly, an object of the present invention is to efficiently print images for which two types of areas, color areas and monochromatic areas, exist in the sub-scan direction.

To attain at least part of the above and other related objects of the present invention, there is provided a printing apparatus that prints images in a monochromatic area on a printing medium with an achromatic ink alone, and in a color area with chromatic inks, by ejecting ink drops from a nozzle to deposit the ink drops on the printing medium to form dots.

This printing apparatus comprises a printing head, a main scan drive unit, a sub-scan drive unit and a control unit. The printing head has a plurality of single chromatic nozzle groups for ejecting mutually different chromatic inks and an achromatic nozzle group for ejecting achromatic ink. The plurality of single chromatic nozzle groups each consists of plurality of nozzles. The achromatic nozzle group consists of a greater number of nozzles than each of the single chromatic nozzle groups. The main scan drive unit moves at least one of the printing head and the printing medium to perform main scanning. The sub-scan drive unit moves at least one of the printing head and the printing medium in a direction that intersects a main scanning direction to perform sub-scanning. The control unit controls the printing head, the main scan drive unit and the sub-scan drive unit.

The printing device performs the following procedure when the lower edge of a monochromatic area and the upper edge of a color area come into contact with each other. Regular monochromatic mode printing is executed whereby sub-scans are performed in a first sub-scan mode, and dots are formed along the main scan lines in the monochromatic area. Lower-edge monochromatic mode printing is executed whereby sub-scans are performed in a second sub-scan mode in which a maximum sub-scan feed increment is less than a maximum sub-scan feed increment of the first sub-scan mode, and dots are formed along the main scan lines in the monochromatic area in the vicinity of a border with the color area. Upper-edge color mode printing is executed whereby sub-scans are performed in a third sub-scan mode, and dots are formed along the main scan lines in the color area in the vicinity of the border with the monochromatic area. Regular color mode printing is executed whereby sub-scans are performed in a fourth sub-scan mode in which a maximum sub-scan feed increment is greater than a maximum sub-scan feed increment of the third sub-scan mode, and dots are formed along the main scan lines in the color area. Adopting this arrangement will result in a smooth transfer from the printing of a monochromatic area to the printing of a color area.

When the nozzles of the single chromatic nozzle groups are arranged at a nozzle pitch kc×D, and the nozzles of the achromatic nozzle group are arranged at a nozzle pitch km×D, the printing procedure may be preferably performed as follows. Specifically, the printing in each of the regular monochromatic mode printing, the lower-edge monochromatic mode printing, the upper-edge color mode printing and the regular color mode printing may be interlaced printing. Note that kc is an integer of 2 or greater, D is a pitch of main scan lines, and km is an integer of 2 or greater. Adopting this arrangement makes it possible to improve the quality of printed results.

The following approach should preferably be adopted when the single chromatic nozzle groups have mutually equal numbers of Nc nozzles (where Nc is an integer of 2 or greater) arranged at a nozzle pitch kc×D (where kc is an integer of 2 or greater), which is kc times the pitch D of the main scan lines, and the achromatic nozzle group has Nm nozzles (where Nm is an integer grate than Nc) arranged at a nozzle pitch km×D (where km is an integer equal to the inverse of the natural portion of kc).

In the regular monochromatic mode printing, monochromatic mode main scans may be preferably performed alternately with the sub-scans in which the achromatic nozzle group is used but the single chromatic nozzle groups are not used. In the lower-edge monochromatic mode printing, the monochromatic mode main scans may be preferably performed at least (km−1) times alternately with the sub-scans. In the upper-edge color mode printing, color mode main scans may be preferably performed at least (kc−1) times alternately with sub-scans in which the plurality of single chromatic nozzle groups and specific achromatic nozzle group are used. The specific achromatic nozzle group may be selected from the achromatic nozzle group and consist of Nc nozzles arranged at a nozzle pitch kc×D. In the regular color mode printing, color mode main scans may be performed alternately with the sub-scans. Adopting this arrangement makes it possible to record images along each main scan line with no gaps between the lines, and to transfer from the printing of monochromatic area to the printing of color area.

It is preferable that the plurality of single chromatic nozzle groups comprise a cyan nozzle group for ejecting a cyan ink, a magenta nozzle group for ejecting a magenta ink and a yellow nozzle group for ejecting a yellow ink. The cyan nozzle group, magenta nozzle group, and yellow nozzle group should preferably be disposed in the order indicated in the direction of sub-scanning. The achromatic nozzle group should preferably be equipped with Nc×3 nozzles arranged at a nozzle pitch kc×D and be disposed in the area for accommodating the nozzles cyan nozzle group, magenta nozzle group, and yellow nozzle group. The specific achromatic nozzle group should preferably be disposed in the area for accommodating the nozzles of the cyan nozzle group in the direction of sub-scanning. Adopting this arrangement makes it less likely that inks will bleed into each other, because the cyan, magenta, and yellow inks ejected within the same pixel are deposited onto this pixel during different main scans. It is also possible to arrange the nozzles of the achromatic nozzle groups in an optimal manner without unduly increasing the size of the print head in the direction of sub-scanning.

When the nozzles of the achromatic nozzle group are arranged at a nozzle pitch km×D, where km is an integer of 2 or greater, the sub-scans should preferably be performed (km−1) times in lower-edge monochromatic mode printing. Adopting this arrangement makes it possible to record images along each main scan line with no gaps between the lines in the monochromatic area in the vicinity of the border with the color area.

When the nozzles of the single chromatic nozzle groups are arranged at a nozzle pitch kc×D, where kc is an integer of 2 or greater, the sub-scans should preferably be performed (kc−1) times in upper-edge color mode printing. Adopting this arrangement makes it possible to record images along each main scan line with no gaps between the lines in the color area in the vicinity of the border with the monochromatic area.

When a topmost nozzle of the plurality of single chromatic nozzle groups is in a position upside of a border of the monochromatic area and the color area, upper-edge color mode printing should preferably be started. Adopting this arrangement makes it possible to record images along the main scan lines of the upper-edge portion of a color area with no gaps between the lines.

After lower-edge monochromatic mode printing and before upper-edge color mode printing, the sub-scan should preferably be performed such that the print head is placed at a specific position near an upper edge of the color area when a distance between the print head and the upper edge of the color area at the end of lower-edge monochromatic mode printing is less than a specific value. Adopting this arrangement makes it possible to print images in an efficient manner without making unnecessary sub-scans.

The sub-scan should preferably be performed such that the print head is put to a first relative position in relation to the printing medium from a second relative position at which the print head is located at the end of lower-edge monochromatic mode printing, when the second relative position falls outside a permissible range of the first relative position. The first relative position is defined to be a position such that when the print head is positioned at the first relative position and upper-edge color mode printing is performed starting from the first relative position, the main scan lines can be recorded without any gaps all the way from the upper edge of the color area. Adopting this arrangement makes it possible to record images along the main scan lines of the upper-edge portion of a color area with no gaps between the lines, to dispense with unnecessary sub-scans, and to print images in an efficient manner.

It is preferable that the printing procedure in regular monochromatic mode printing proceeds to lower-edge monochromatic mode printing without position adjusting feed in case as follows. The case is that a first relative position of the print head in relation to the printing medium lies below a second relative position. The first relative position is defined to be a position reached by the print head when a subsequent sub-scan in the first sub-scan mode and all the sub-scans to be performed during lower-edge monochromatic mode printing are performed. The second relative position is defined to be a position such that when the print head is positioned at the second relative position and upper-edge color mode printing is performed starting from the second relative position, the main scan lines can be recorded without any gaps all the way from the upper edge of the color area. Adopting this arrangement makes it possible to transfer from the printing of monochromatic area to the printing of color area without performing sub-scanning in the reverse direction.

When the nozzles of the achromatic nozzle group are arranged at a nozzle pitch km×D, the first sub-scan mode in the regular monochromatic printing mode should preferably be a mode for carrying out a constant sub-scan feeding with constant feed increments of p1×D. Note that km is an integer of 2 or greater, D is a pitch of main scan lines and p1 is an integer constituting a prime with km.

When the nozzles of the single chromatic nozzle groups are arranged at a nozzle pitch kc×D, the fourth sub-scan mode in regular color mode printing should preferably be a mode for carrying out a constant sub-scan feeding with constant feed increments of q1×D. Note that kc is an integer of 2 or greater and D is a pitch of main scan lines and q1 is an integer constituting a prime with kc.

When the nozzles of the achromatic nozzle group are arranged at a nozzle pitch km×D, the second sub-scan mode in lower-edge monochromatic mode printing should preferably be a mode for carrying out a constant sub-scan feeding with constant feed increments of p2×D. Note that km is an integer of 2 or greater, D is a pitch of main scan lines and p2 is an integer constituting a prime with km.

When the nozzles of the single chromatic nozzle groups are arranged at a nozzle pitch kc×D, the third sub-scan mode in upper-edge color mode printing should preferably be a mode for carrying out a constant sub-scan feeding with constant feed increments of q2×D. Note that kc is an integer of 2 or greater, D is a pitch of main scan lines and q2 is an integer constituting a prime with kc.

Adopting these arrangements makes it possible to record images along the main scan lines through a simple procedure and with no gaps between the lines by following individual sub-scan modes.

In the third sub-scan mode in upper-edge color mode printing, q2 should preferably be 1. Adopting this arrangement makes it possible to reduce the number of main scans performed during upper-edge color mode printing. It is also possible to set the value of p2 to 1 in the second sub-scan mode for performing lower-edge monochromatic mode printing.

The first sub-scan mode in regular monochromatic mode printing may be a mode for carrying out a non-constant sub-scan feeding that includes performing repeated combinations of sub-scans in variable feed increments. The fourth sub-scan mode in regular color mode printing may be a mode for carrying out a non-constant sub-scan feeding that includes performing repeated combinations of sub-scans in variable feed increments. Adopting this arrangement makes it possible to further improve the quality of printing results in each sub-scan mode. The second sub-scan mode for performing lower-edge monochromatic mode printing can also be made into a mode designed for non-constant sub-scan feeding, as can the third sub-scan mode for performing upper-edge color mode printing.

The following arrangement should preferably be adopted when the lower edge of a color area and the upper edge of a monochromatic area are in contact with each other. Regular color mode printing is executed whereby sub-scans are performed in a first sub-scan mode, and dots are formed along the main scan lines in the color area. Lower-edge color mode printing is executed whereby sub-scans are performed in a second sub-scan mode in which a maximum sub-scan feed increment is less than a maximum sub-scan feed increment of the first sub-scan mode, and dots are formed along the main scan lines in the color area in the vicinity of the border with the monochromatic area. Upper-edge monochromatic mode printing is executed whereby sub-scans are performed in a third sub-scan mode, and dots are formed along the main scan lines in the monochromatic area in the vicinity of a border with the color area. Regular monochromatic mode printing is executed whereby sub-scans are performed in a fourth sub-scan mode in which a maximum sub-scan feed increment is greater than a maximum sub-scan feed increment of the third sub-scan mode, and dots are formed along the main scan lines in the monochromatic area. Adopting this arrangement will result in a smooth transfer from the printing of a color area to the printing of a monochromatic area.

When the nozzles of the single chromatic nozzle groups are arranged at a nozzle pitch kc×D, and the nozzles of the achromatic nozzle group are arranged at a nozzle pitch km×D, the printing procedure may be preferably performed as follows. Specifically, in the regular color mode printing, the lower-edge color mode printing, the upper-edge monochromatic mode printing and the regular monochromatic mode printing, interlaced printing may be preferably executed. Note that kc is an integer of 2 or greater, D is a pitch of main scan lines and km is an integer of 2 or greater. Adopting this arrangement makes it possible to improve the quality of printed results.

The following approach should preferably be adopted when the single chromatic nozzle groups have mutually equal numbers of Nc nozzles arranged at a nozzle pitch kc×D, and the achromatic nozzle group has Nm nozzles arranged at a nozzle pitch km×D. Note that Nc is an integer of 2 or greater, kc is an integer of 2 or greater, D is a pitch of main scan lines, Nm is an integer grater than Nc, km is an integer equal to kc/J and J is a positive integer.

In regular color mode printing, color mode main scans are performed alternately with the sub-scans in which the plurality of single chromatic nozzle groups and specific achromatic nozzle group are used. The specific achromatic nozzle group is selected from the achromatic nozzle group and consists of Nc nozzles arranged at a nozzle pitch kc×D. In lower-edge color mode printing, the color mode main scans are performed at least (km−1) times alternately with the sub-scans. In upper-edge monochromatic mode printing, monochromatic mode main scans are performed at least (kc−1) times alternately with sub-scans in which the achromatic nozzle group are used but the single chromatic nozzle groups are not used. In regular monochromatic mode printing, the monochromatic mode main scans are performed alternately with the sub-scans. Adopting this arrangement makes it possible to record images along each main scan line with no gaps between the lines, and to transfer from the printing of a color area to the printing of a monochromatic area.

When the nozzles of the single chromatic nozzle groups are arranged at a nozzle pitch kc×D, where kc is an integer of 2 or greater, the sub-scans should preferably be performed (kc−1) times in lower-edge color mode printing. Adopting this arrangement makes it possible to record images along each main scan line with no gaps between the lines in the color area in the vicinity of the border with the monochromatic area.

When the nozzles of the achromatic nozzle group are arranged at a nozzle pitch km×D, where km is an integer of 2 or greater, the sub-scans should preferably be performed (km−1) times in upper-edge monochromatic mode printing. Adopting this arrangement makes it possible to record images along each main scan line with no gaps between the lines in the monochromatic area in the vicinity of the border with the color area.

When a topmost nozzle of the achromatic nozzle group is in a position upside of a border of the color area and the monochromatic area, upper-edge monochromatic mode printing should preferably be started. Adopting this arrangement makes it possible to record images along the main scan lines of the upper-edge portion of a monochromatic area with no gaps between the lines.

It is preferable that the sub-scan is performed such that the print head is placed at a specific position near an upper edge of the monochromatic area when a distance between the print head and the upper edge of the monochromatic area at the end of lower-edge color mode printing is less than a specific value. Adopting this arrangement makes it possible to print images in an efficient manner without making unnecessary sub-scans.

The sub-scan of the position adjusting feed may preferably performed such that the print head is put to a first relative position in relation to the printing medium from a second relative position at which the print head is located at the end of lower-edge color mode printing, when the second relative position falls outside a permissible range of the first relative position. The first relative position is defined to be a position such that when the print head is positioned at the first relative position and upper-edge monochromatic mode printing is performed starting from the first relative position, the main scan lines can be recorded without any gaps all the way makes it possible to record images along the main scan lines of the upper-edge portion of a monochromatic area with no gaps between the lines, to dispense with unnecessary sub-scans, and to print images in an efficient manner.

In the regular color mode printing, it is preferable that the printing procedure proceeds to lower-edge color mode printing without position adjusting feed in the case as follows. The case is that a first relative position of the print head in relation to the printing medium lies below a second relative position. The first relative position is defined to be a position reached by the print head when a subsequent sub-scan in the first sub-scan mode and all the sub-scans to be performed during lower-edge color mode printing are performed. The second relative position is defined to be a position such that when the print head is positioned at the second relative position and upper-edge monochromatic mode printing is performed starting from the second relative position, the main scan lines can be recorded without any gaps all the way from the upper edge of the monochromatic area. Adopting this arrangement makes it possible to transfer from the printing of color area to the printing of monochromatic area without performing sub-scanning in the reverse direction. Each sub-scan mode can be made into a mode designed for constant sub-scan feeding. A mode designed for non-constant sub-scan feeding can also be obtained.

In case that the nozzles of the single chromatic nozzle groups are arranged at a nozzle pitch kc×D, the second sub-scan mode in lower-edge color mode printing should preferably be a mode for carrying out a constant sub-scan feeding with constant feed increments of q2×D. Note that kc is an integer of 2 or greater, D is a pitch of main scan lines and q2 is an integer constituting a prime with kc.

When the nozzles of the achromatic nozzle group are arranged at a nozzle pitch km×D, the third sub-scan mode in upper-edge monochromatic mode printing should preferably be a mode for carrying out a constant sub-scan feeding with constant feed increments of p2×D. Note that km is an integer of 2 or greater, D is a pitch of main scan lines and p2 is an integer constituting a prime with km.

Adopting these arrangements makes it possible to record images along the main scan lines through a simple procedure and with no gaps between the lines by following individual sub-scan modes.

In the second sub-scan mode in lower-edge color mode printing, q2 should preferably be 1. Adopting this arrangement makes it possible to reduce the number of main scans performed during lower-edge color mode printing. It is also possible to set the value of p2 to 1 in the third sub-scan mode for performing upper-edge monochromatic mode printing.

The present invention can be realized in a variety of embodiments such as those shown below.

(1) Printing method and printing control method
(2) Printing apparatus and printing control apparatus
(3) A computer program for realizing the aforementioned device or method
(4) A recording medium on which is recorded a computer program for realizing the aforementioned device or method
(5) Data signals implemented within carrier waves including a computer program for realizing the aforementioned device or method These and other objects, features, aspects, and advantages of the present invention will become more apparent from the following detailed description of the preferred embodiments with the accompanying drawings.

DESCRIPTION OF THE PREFERRED EMBODIMENT

Embodiments of the present invention will now be described through working examples in the following order.

Figure 4:
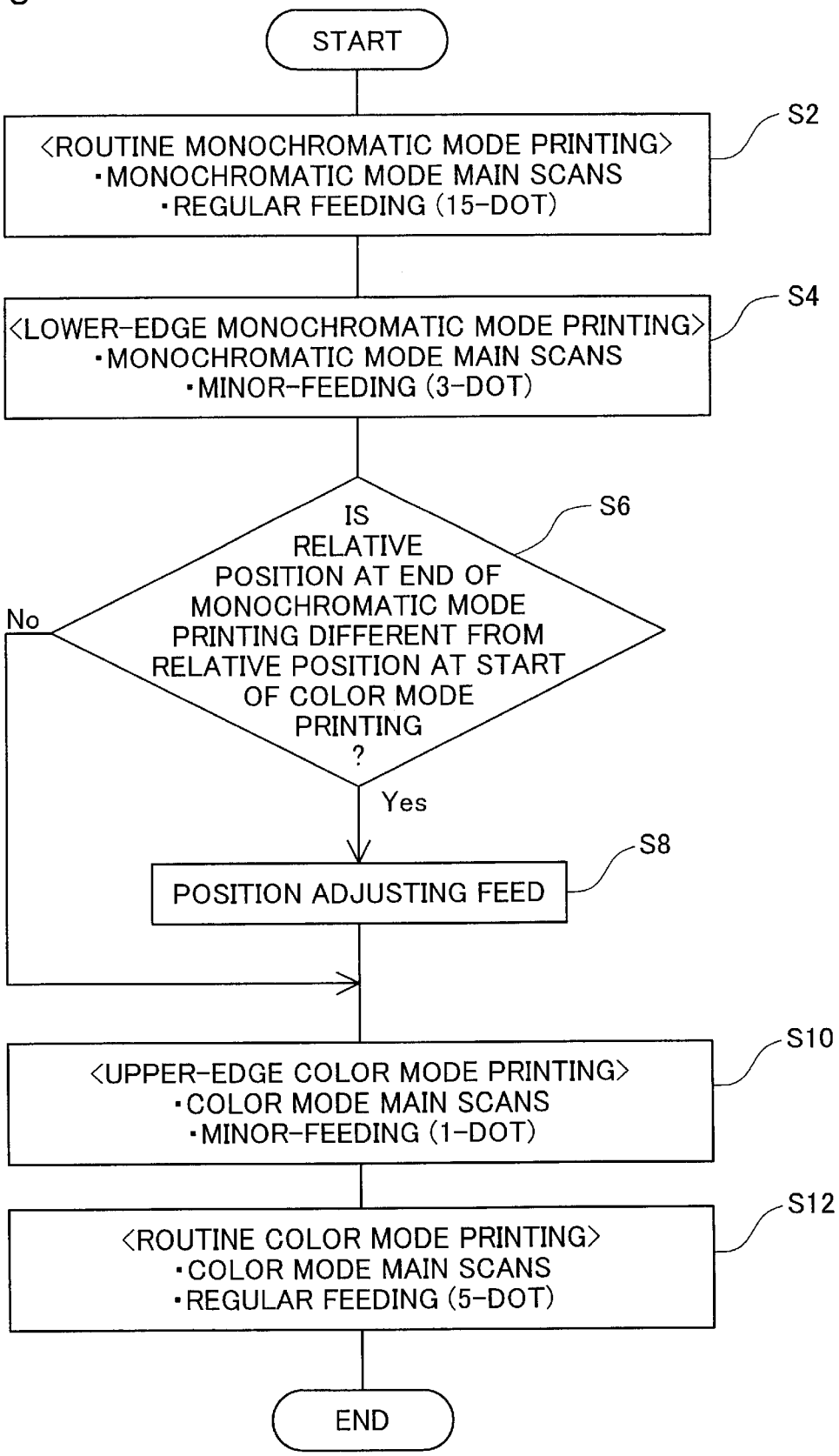
FIG. 4 is a flowchart depicting the procedure for the transfer from monochromatic mode printing to color mode printing.

A. Overview
B. First Working Example
B1. Device Structure
B2. Printing
C. Second Working Example
C1. Device Structure
C2. Printing
D. Modifications A. Overview In monochromatic printing, regular feeding is first performed in 15-dot feed increments while dots are recorded in the course of main scanning by all black nozzle Nos. 1–15 (monochromatic mode main scans) in step S2 (FIG. 4). Minor-feeding is then performed in 3-dot feed increments while all black nozzle Nos. 1–15 are used in step S4 in the same manner before the device proceeds from monochromatic mode printing to color mode printing. In step S6, it is determined whether the relative position between the print head and the printing paper at the end of minor-feeding differs from a specific relative position needed for this position to be reached at the start of the color mode printing. If the positions do indeed differ, a position adjusting feed is performed in step S8. The device then proceeds to color mode printing.

In color mode printing, Nozzle Nos. 1–5 of each of cyan (C), magenta (M), and yellow (Y) nozzle groups are used, and nozzle Nos. 11–15 of black (K) nozzle group are used. Immediately after the transfer from the monochromatic mode, main scans (color mode main scans) are performed using five nozzles for each of the above colors, and minor-feeding is performed in single-dot feed increments in step S10. Regular feeding is then performed in 5-dot feed increments while five nozzles are used for each of the above colors in step S12 in the same manner.

B. First Working Example

B1. Device Structure

Figure 1:
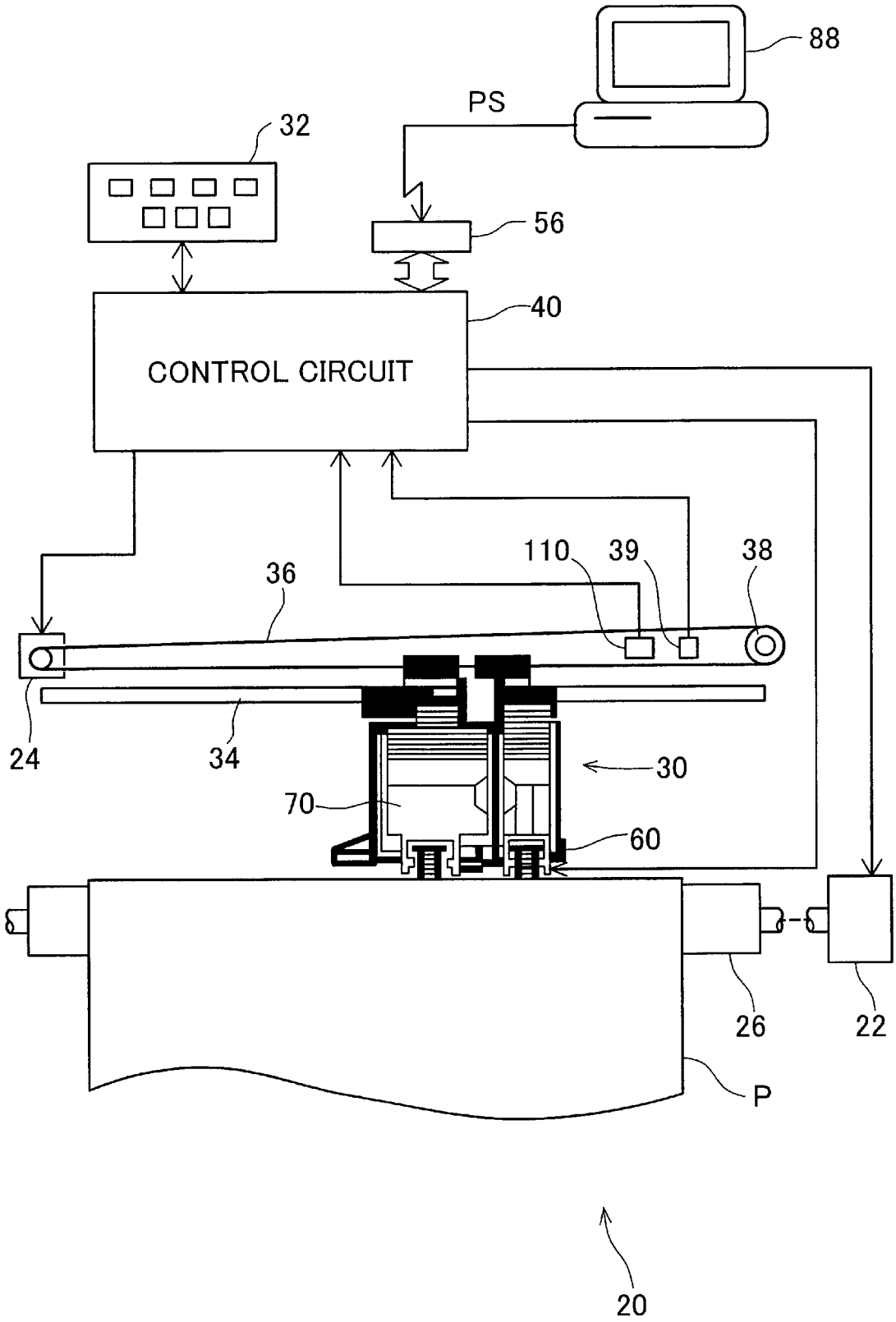
FIG. 1 is a schematic block diagram of a printing system equipped with the printer 20 of the first working example.

FIG. 1 is a schematic structural diagram of a printing system equipped with an inkjet printer 20 as a working example of the present invention. This printer 20 is equipped with a main scan feeding mechanism that slides carriage 30 back and forth along sliding axis 34 using carriage motor 24, a sub-scan feeding mechanism that transports printing paper P in a direction perpendicular to the main scan direction (called "the sub-scan direction") using paper feed motor 22, a head driving mechanism that drives printing head unit 60 which is on carriage 30 and controls ink ejection and dot formation, and control circuit 40 which exchanges the control signals with these paper feed motor 22, carriage motor 24, printing head unit 60, and operating panel 32. Control circuit 40 is connected to computer 88 via connector 56.

The main scanning mechanism for reciprocating the carriage 30 comprises a sliding shaft 34 mounted on the platen 26 and designed to slidably support the carriage 30, a pulley 38 for extending an endless drive belt 36 between the carriage 30 and the carriage motor 24, and a position sensor 39 for sensing the origin position of the carriage 30. The sub-scanning mechanism for transporting the printing paper P is provided with a gear train (not shown) for transmitting the rotation of the paper feed motor 22 to a paper feed roller (not shown). The paper feed roller transports the printing paper in the direction perpendicular to the sliding direction of the carriage 30.

Figure 2:
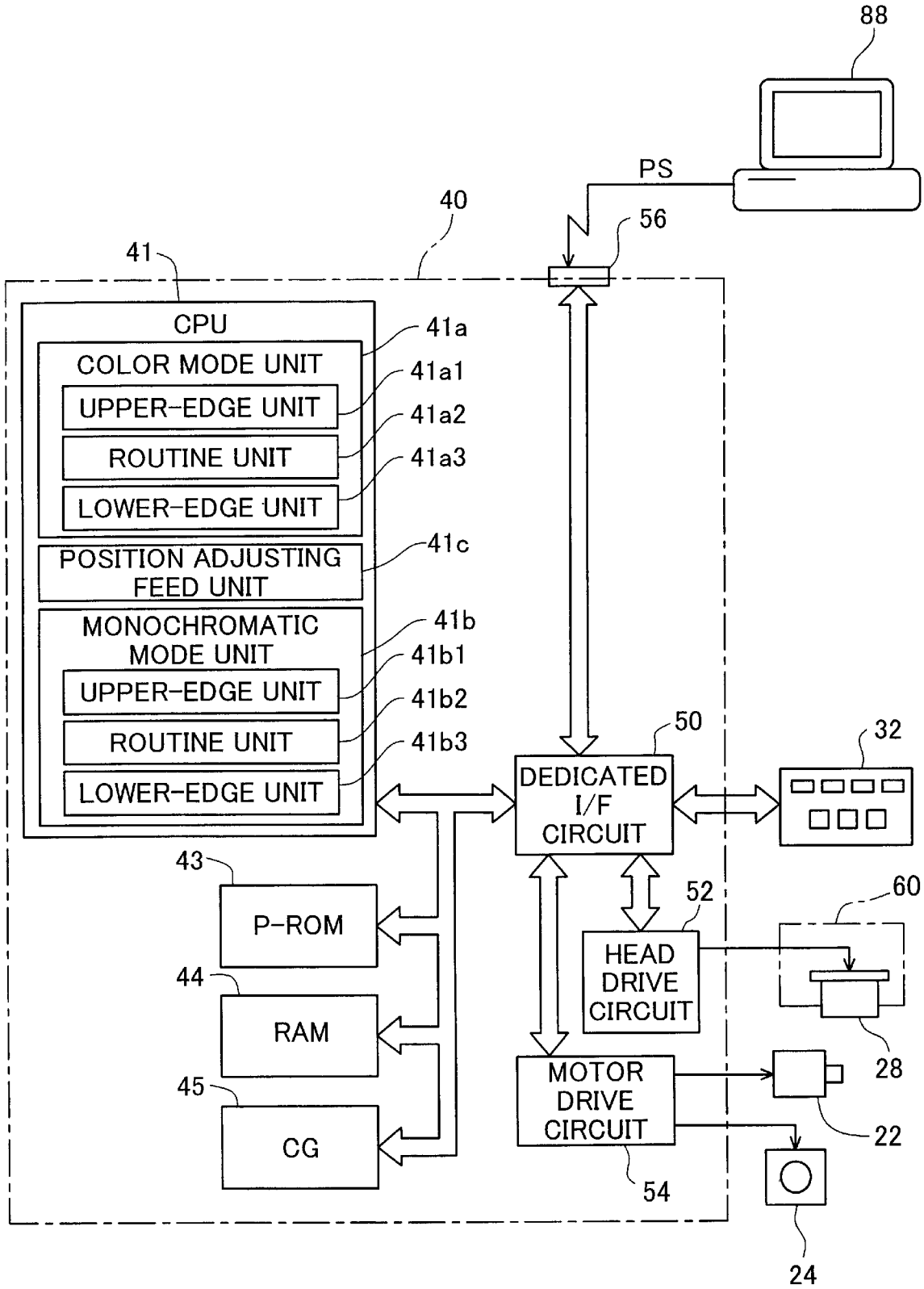
FIG. 2 is a block diagram depicting the structure of the control circuit 40 for the printer 20.

FIG. 2 is a block diagram that shows the structure of a printer 20 with control circuit 40 as its core. Control circuit 40 is formed as an arithmetic logical operation circuit comprising a CPU 41, programmable ROM (PROM) 43, RAM 44, and a character generator (CG) 45 that records the dot matrix of characters. This control circuit 40 further comprises an dedicated interface circuit 50 that performs an interface exclusively with an external motor, a head drive circuit 52 that is connected to this dedicated interface circuit 50, drives the printing head unit 60, and ejects ink, and a motor drive circuit 54 that drives paper feed motor 22 and carriage motor 24. Dedicated interface circuit 50 has a built in parallel interface circuit, and can receive printing signal PS supplied from computer 88 via connector 56. By executing the computer program stored in PROM 42, CPU 41 functions as the color mode unit 41*a*, monochromatic mode unit 41*b* and position adjusting feed unit 41*c* to be described later.

Printing head 28 has a plurality of nozzles n provided in a row for each color, and an actuator circuit 90 that operates the piezo element PE that is provided on each nozzle n. Actuator circuit 90 is part of head drive circuit 52 (see FIG. 2), and performs on/off control of drive signals given from the drive signal generating circuit (not illustrated) within head drive circuit 52. Specifically, actuator circuit 90 latches data that shows on (ink is ejected) or off (ink is not ejected) for each nozzle according to the print signal PS supplied from computer 88, and the drive signal is applied to the piezo element PE only for the nozzles that are on.

Figure 3:
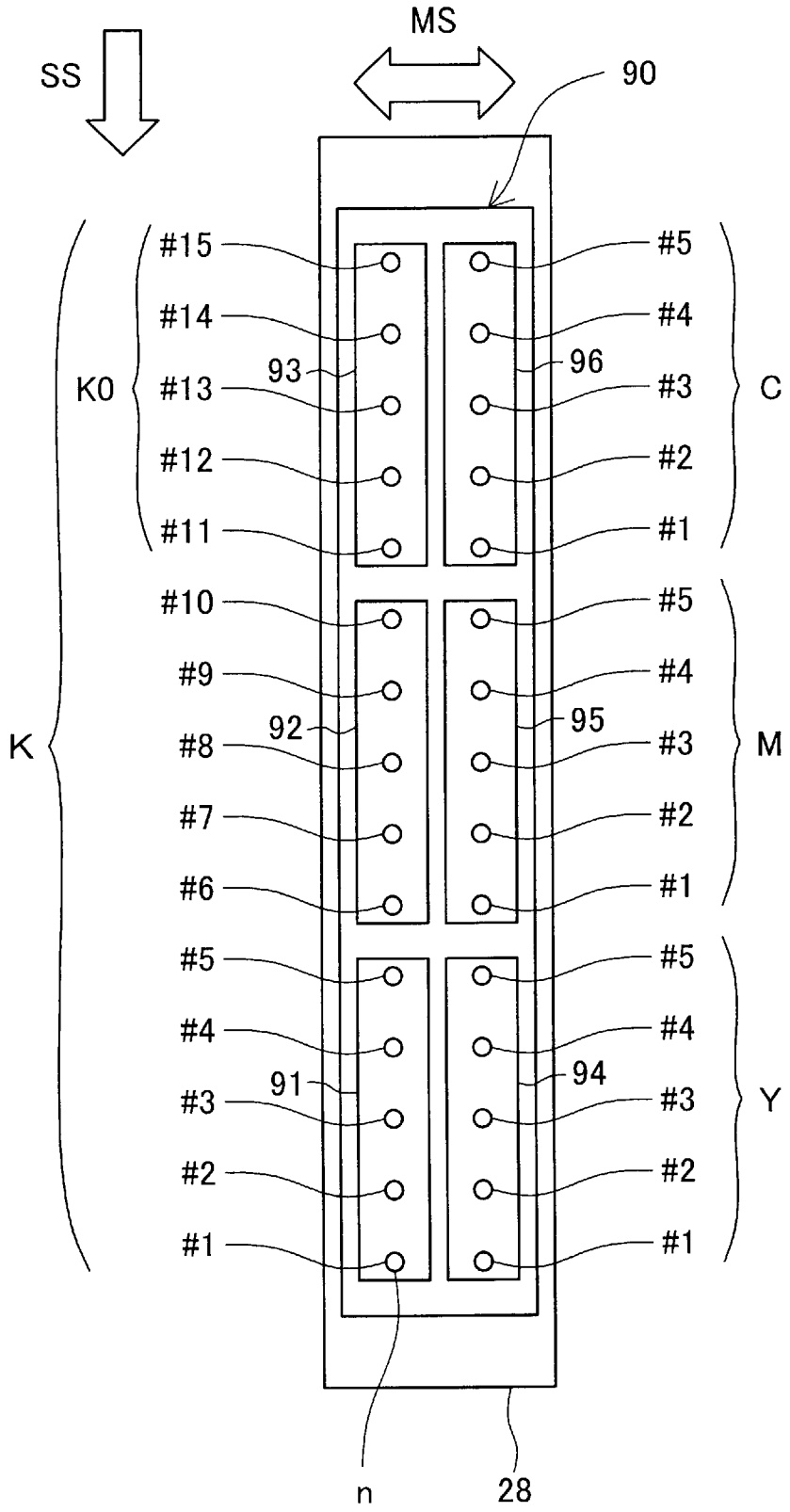
FIG. 3 is a diagram depicting a nozzle arrangement provided to the print head 28*a;*

FIG. 3 is an explanatory diagram that shows the arrangement of nozzles provided on printing head 28. This printer 20 is a printing apparatus that performs printing using four colors of ink, black (K), cyan (C), magenta (M), and yellow (Y), and five nozzles each are provided for cyan (C), magenta (M), and yellow (Y), while fifteen nozzles are provided for black (K). The cyan nozzle group, magenta nozzle group, and yellow nozzle group are arranged in sequence in the direction of sub-scanning. The black nozzle group is disposed in the area for accommodating the nozzles of the cyan nozzle group, single chromatic nozzle group, and yellow nozzle group in the direction of sub-scanning. Nozzles #1 trough #5 of cyan (C), magenta (M) and yellow (Y) correlate to the "single chromatic nozzle group" noted in the claims. Nozzles #1 through #15 for black (K) correlate to the "achromatic nozzle group" noted in the claims.

Provided in actuator circuit 90 are actuator chips 91 to 93 which drive black nozzle row K, actuator chip 94 which drives cyan nozzle row C, actuator chip 95 which drives magenta nozzle row M, and actuator chip 96 which drives yellow nozzle row Y.

Printing head 28 slides back and forth along sliding axis 34 in the direction of arrow MS by carriage motor 24. Printing paper P is sent in the arrow SS direction in relation to printing head 28 by paper feed motor 22.

Figure 5:
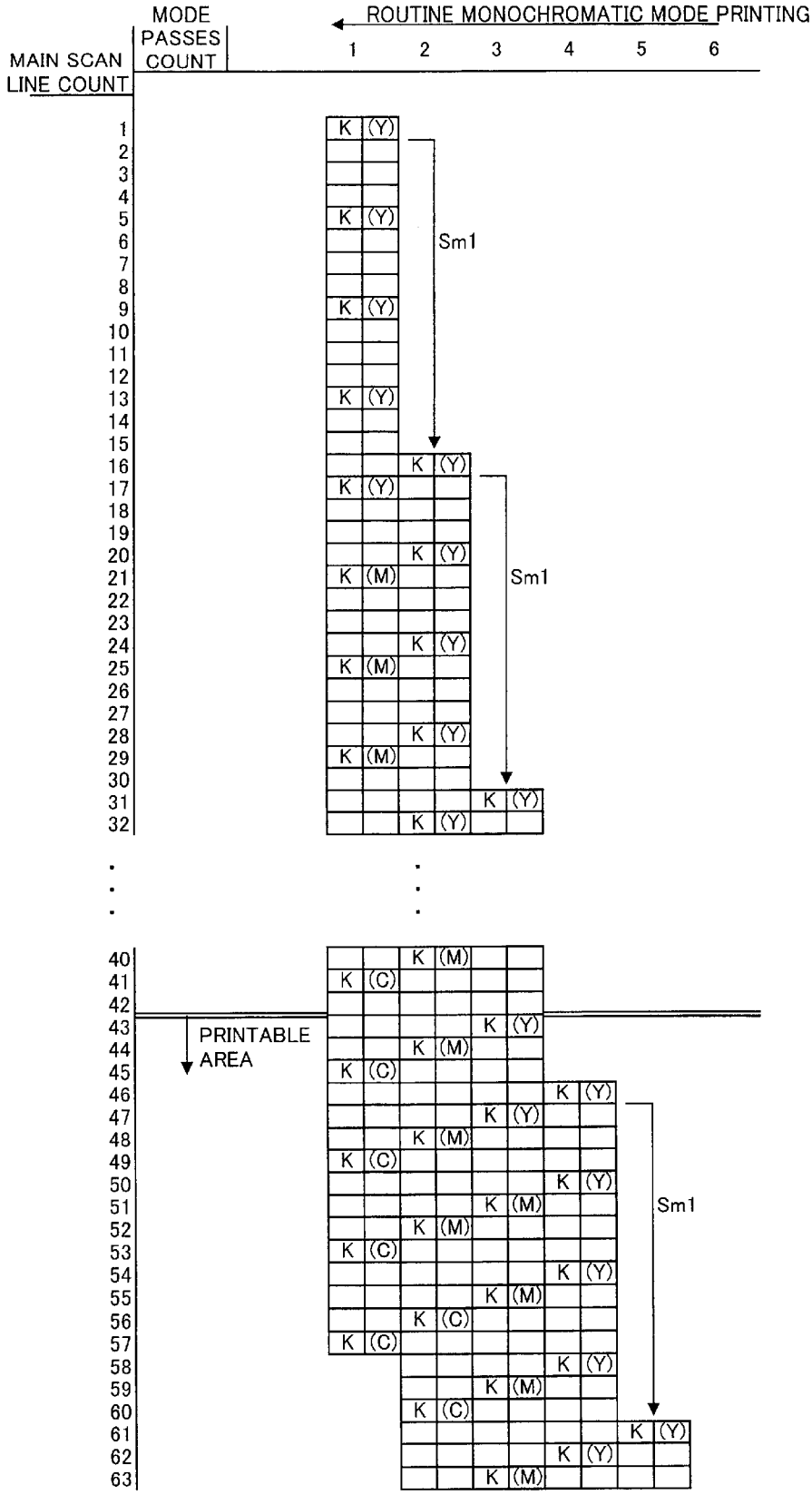
FIG. 5 is a diagram depicting the manner in which each main scan line is recorded during routine feeding in the monochromatic mode.

B2. Printing (1) Transfer from Monochromatic Mode Printing to Color Mode Printing FIG. 4 is a flowchart depicting the procedure for the transfer from monochromatic mode printing to color mode printing. FIG. 5 is a diagram depicting the manner in which each main scan line is recorded during routine feeding in the monochromatic mode. In FIG. 5, the numbers of main scan lines are shown on the left side. The print head is represented as squares arranged in 57 rows and 2 columns, and symbols K, C, M, and Y are used to denote the colors of the inks ejected by the nozzles at each of nozzle position on the print head. Since monochromatic mode printing is carried out using black nozzles alone without the use of cyan, magenta, or yellow nozzles, the symbols of ink colors are enclosed in parentheses to indicate corresponding positions. The numbers of passes needed to record each raster line are shown in the upper part of FIG. 5. A pass is a single main scan. According to the first working example, a single sub-scan is performed for each main scan. Although in practice the printing paper P is transported relative to the print head and the relative position of the two varies, it is shown herein for the sake of simplicity that the print head moves down relative to the printing paper P. Also for the sake of simplicity, the print head is shown in FIG. 5 moving to the left with every sub-scan. When the recording of each main scan line is described in this specification, "up" is used for the direction of the front edge and "down" is used for the direction of the rear edge when the printing paper P is fed by the paper feed motor 22.

In the first working example, constant sub-scan feeding in 15-dot feed increments Sm is first preformed in step S2 (FIG. 4) during monochromatic mode printing. The constant sub-scan feeding is performed while monochromatic mode main scan for recording dots in the course of main scanning is carried out using all the nozzles belonging to the group composed of black nozzle Nos. 1–15. As used herein, the term "one dot" is the interval between two raster lines in the direction of sub-scanning (see FIG. 5). In addition, the term "using the nozzles of a nozzle group" refers to the fact that the nozzles of a nozzle group are used as needed. Consequently, the term "using the nozzles of a nozzle group" applies to cases in which only some of the nozzles in a nozzle group are used. Depending on the data about the images to be printed and the combination of nozzles passing over a raster, there may be cases in which some of the other nozzles remain unused. In addition, the phrase "the nozzles of a nozzle group are not used" for a certain procedure refers to cases in which none of the nozzles belonging to a nozzle group are ever used for this procedure.

Constant sub-scan feeding in 15-dot increments during monochromatic mode printing is referred to as the "routine feeding" of monochromatic mode printing. Performing this type of feeding allows each of the main scan lines on the printing paper P to be recorded without intervals between them. In FIG. 5, gap-less recording cannot be achieved for the upper main scan lines at or above the $42^{nd}$ line, and can be achieved for the main scan lines at or below the $43^{rd}$ line. Consequently, the area below the $43^{rd}$ line is a recordable area in which images can be substantially recorded. The term "routine monochromatic mode printing" is applied to a printing procedure performed using routine feeding during step S2 while monochromatic mode main scans are performed.

The term "interlaced printing" is applied to a recording method in which dots are freshly recorded on every second main scan line (or on one out of every several main scan lines) in an area to be freshly recorded while dots are recorded on the main scan lines in the intervals between the previously recorded main scan lines in a manner similar to the one adopted for the regular monochromatic mode printing in FIG. 5. By contrast, the term "band printing" is applied to a method in which all the lines in a continuous cluster of main scan lines are recorded, the print head is caused to perform a sub-scan beyond the already recorded main scan lines, the next cluster of main scan lines are recorded, and the process is repeated. Performing such band printing sometimes causes lines to be formed between the clusters of main scan lines recorded in a single cycle (or continuously recorded via small sub-scan feeds), whereas interlaced printing is devoid of such problems. Specifically, it is possible to improve the quality of printed results.

Figure 6:
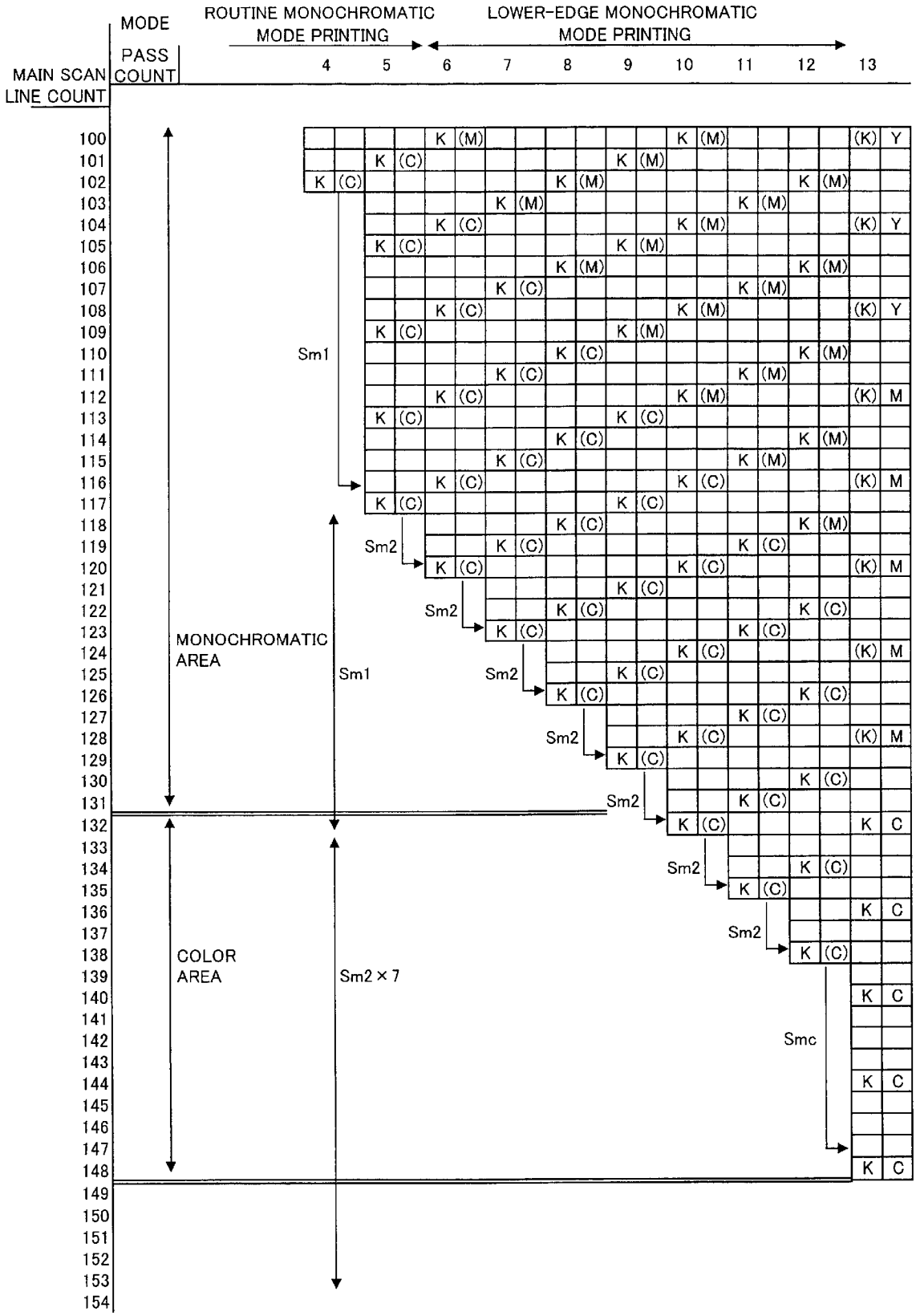
FIG. 6 is a diagram depicting the micro-feeds and position adjusting feed performed during monochromatic mode printing.

FIG. 6 is a diagram depicting the micro-feeds and position adjusting feed performed during monochromatic mode printing. Following the routine feeding in step S2 in FIG. 4, constant sub-scan feeding is performed in step S4 in feed increments Sm2 (each of them equal to 3 dots) while monochromatic mode main scans are performed before the transfer from monochromatic mode printing to color mode printing. In FIG. 6, sub-scanning based on such 3-dot constant sub-scan feeding extends from the sub-scans performed after the fifth pass to the sub-scans performed before the $12^{th}$ pass. The 3-dot constant sub-scan feeding performed during monochromatic mode printing is referred to as the "minor-feeding" of monochromatic mode printing. The main scan lines in the monochromatic areas near the border with color area are recorded without any intervals by means of the fifth to $12^{th}$ passes, which are performed before and after such minor-feedings.

The term "lower-edge monochromatic mode printing" is applied to a printing procedure performed using minor-feeding in step S4 while monochromatic mode main scans are performed. The printing procedure for recording dots in monochromatic areas is referred to as "monochromatic mode printing." Monochromatic mode printing includes the below-described upper-edge monochromatic mode printing in addition to regular monochromatic mode printing and lower-edge monochromatic mode printing. The monochromatic mode printing is performed with the aid of a monochromatic mode unit 41*b* (see FIG. 2). The regular monochromatic mode printing of step S2 is performed with the aid of the routine unit 41*b*2 of the monochromatic mode unit 41*b*, whereas the lower-edge monochromatic mode printing of step S4 is performed by a lower-edge unit 41*b*3.

When images are printed in large feed increments, as in the case of 15-dot routine feeding, any attempt to record dots without any intervals in a specific area (for example, in the monochromatic area extending all the way to the $131^{st}$ line in FIG. 6) all the way to the lower edge in the direction of sub-scanning will create a need for the print head to be moved to a relative position significantly below the lower edge of the area. There is, however, no need for the print head to be moved to a relative position significantly below the area in which the dots are to be recorded when the system is fed in small increments, as in the case of 3-dot minor-feeding. In the example shown in FIG. 6, the print head is moved such that the lower edge of the black nozzle group reaches the position of the $138^{th}$ line, which is 7 dots beyond the border between the monochromatic and color areas, in a state in which the main scan lines of the monochromatic area have been completely recorded without any intervals. By contrast, the lower-edge nozzles of the print head reach the position of the $177^{th}$ line (not shown in FIG. 6), which is 46 dots beyond the border between the monochromatic and color areas, when main scan lines have been recorded all the way to the lower edge of the monochromatic area without any intervals in 15-dot feed increments.

Figure 7:
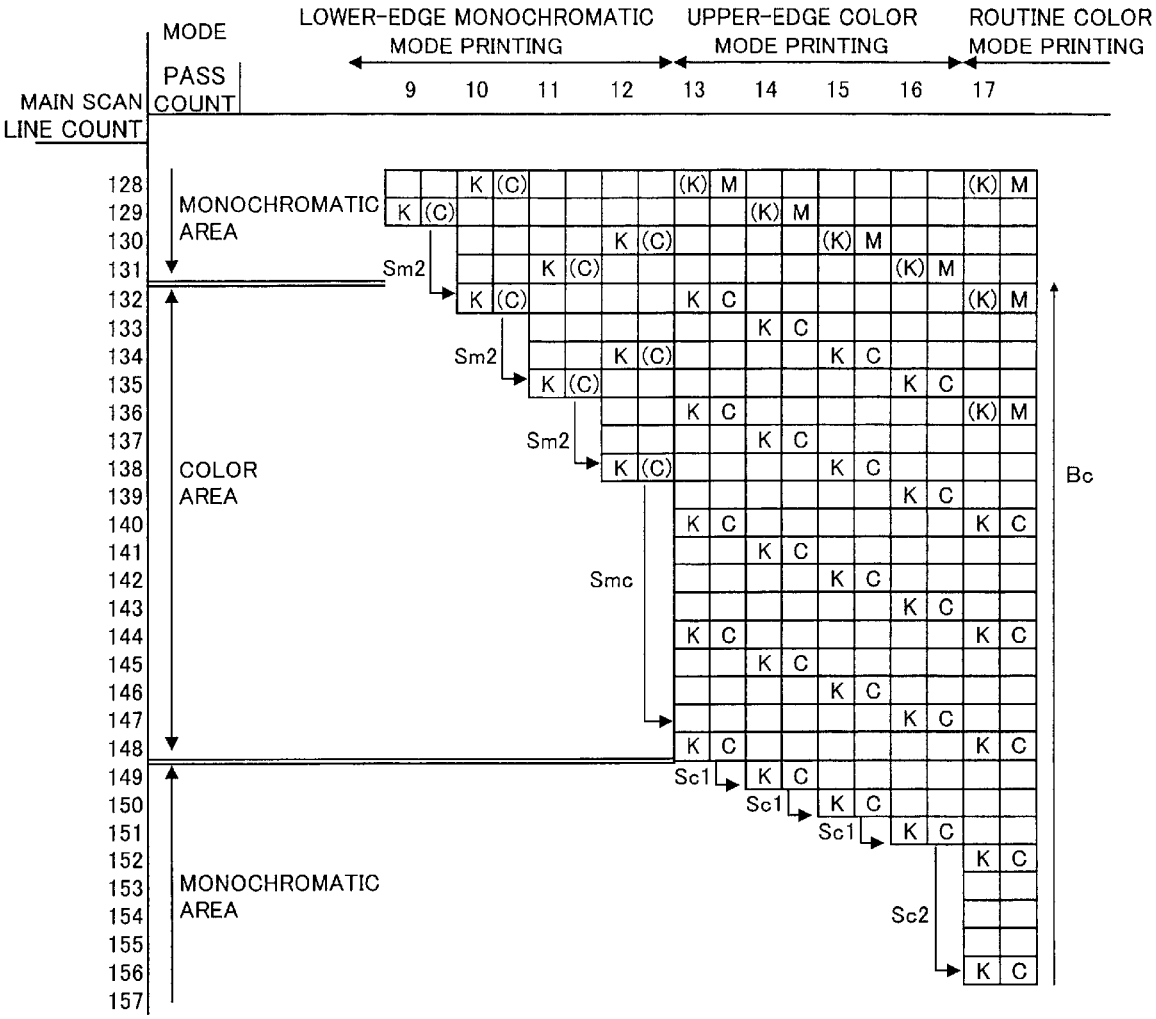
FIG. 7 is a diagram depicting the position adjusting feed performed during the transition from monochromatic mode printing to color mode printing, and the minor-feeding performed in the color mode.

FIG. 7 is a diagram depicting the position adjusting feed performed during the transition from monochromatic mode printing to color mode printing, and the minor-feeding performed in the color mode. Following step S4 in FIG. 4, it is determined if a position adjusting feed is needed in step S6, and a position adjusting feed is performed in step S8 if such a need exists. In the example shown in FIG. 7, the sub-scanning performed following the $12^{th}$ pass represents such a position adjusting feed. The position adjusting feed has a feed increment Smc of 10 dots. The position adjusting feed is carried out by a position adjusting feed unit 41*c* (see FIG. 2).

In step S6, a comparison is drawn between the relative position of the print head at the end of step S4 and the relative position of the print head at the start of upper-edge color mode printing such as the one in which main scan lines can be recorded without any intervals all the way from the upper edge of the color area during the upper-edge color mode printing described in detail below, and it is determined whether the two positions differ from each other. In the example shown in FIG. 7, the relative position of the print head at the start of a printing operation (such as the one in which the main scan lines can be recorded without any intervals all the way from the upper edge of the color area during upper-edge color mode printing) is such that the nozzles along the lower edge of the print head are aligned with the $148^{th}$ line. The relative position of the print head at the end of step S4, that is, at the end of the monochromatic mode, is such that the nozzles along the lower edge are aligned with the $138^{th}$ line. Since the two differ from each other, a position adjusting feed is performed in 10-dot feed increments Smc from the relative position at which the nozzles along the lower edge are aligned with the $138^{th}$ line to the relative position at which the nozzles along the lower edge are aligned with the $148^{th}$ line.

Color mode printing is performed during and after step S10. The same number of nozzles is used for each color during such color mode printing. Nozzle Nos. 1–5 are used for cyan (C), magenta (M), and yellow (Y), and only five nozzles (nozzle Nos. 11–15) are used for black (K) (see FIG. 3). A main scan accompanied by the ejection of ink drops from these nozzles is referred to as a "color mode main scan." The black nozzles used during the color mode main scan are referred to as a "special black nozzle group K0." The special black nozzle group K0 is disposed in the area in which the nozzles of the cyan nozzle group are located in the direction of sub-scanning.

During color mode printing, constant sub-scan feeding is performed in single-dot feed increments Sc1 while five nozzles of each color are used in step S10 in FIG. 4 immediately after the transfer from the monochromatic mode. In FIG. 7, the period between the sub-scans performed after the $13^{th}$ pass and the sub-scans performed before the $16^{th}$ pass corresponds to sub-scans based on such 1-dot constant sub-scan feeding. The 1-dot constant sub-scan feeding performed during such color mode printing is referred to as the "minor-feeding" of color mode printing.

The color area from the $132^{nd}$ line to the $148^{th}$ line is recorded with cyan and black inks without any intervals through four main scans ($13^{th}$ to $16^{th}$ passes in FIG. 7) that precede and follow these three sub-scans. The term "upper-edge color mode printing" is applied to a printing procedure performed using minor-feeding in step S10 while color mode main scans are performed.

In the example shown in FIG. 7, the cyan and black nozzles move from the $132^{nd}$ line to the $151^{st}$ line during the $13^{th}$ to $16^{th}$ passes, which are performed with interposed minor-feeding. The main scan lines can therefore be recorded with cyan and black inks without any intervals. In the example in FIG. 7, the color area extends from the $132^{nd}$ line to the $148^{th}$ line, so the entire color area can be recorded with cyan and black inks without any intervals through these main scans. For a color area that extends below the $151^{st}$ line, however, only the main scan lines disposed in the color area near the border with the monochromatic area can be recorded without any intervals.

When images are printed in large feed increments (such as those used for the 5-dot routine feeding described below) and an attempt is made to record dots all the way from the upper edge of a specific area (for example, a color area extending from the $132^{nd}$ line to the $148^{th}$ line) in the direction of sub-scanning without any intervals, the print head must start printing images at a position significantly above the upper edge of this area. It is, however, possible to record dots without any intervals all the way from the upper edge of the area to be recorded even when the printing is not started from a position in which the print head is significantly above the upper edge of the area, in cases the feeding is performed at small feed increments, such as when minor-feeding is performed in single dots. In the example in FIG. 7, color mode printing is started from a relative position at which the nozzles along the upper edge of specific black and cyan nozzle groups are aligned with a main scan line ($132^{nd}$ line) along the upper edge of the color area. By contrast, in order that main scan lines to be recorded all the way from the upper edge of the color area without any intervals in 5-dot feed increments, color mode printing must be started from a state in which the positions of nozzles on the upper edge of the specific black nozzle group and the cyan nozzle group range in the $120^{th}$ line, which is 12 dots above the border between the monochromatic and color areas. In other words, color mode printing must be carried out from a state in which the nozzles at the lower edge of the print head are aligned with the $136^{th}$ line.

Figure 8:
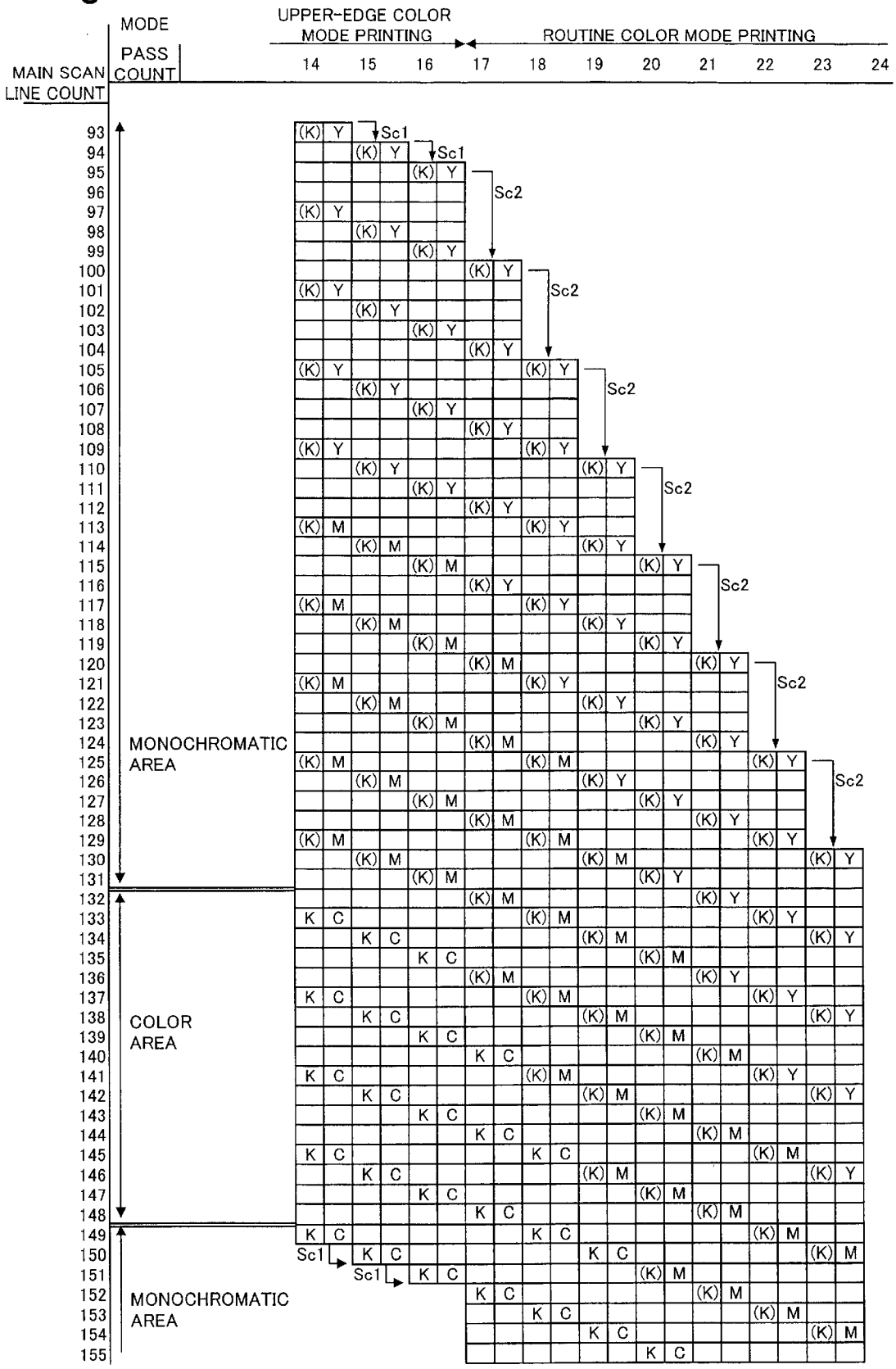
FIG. 8 is a diagram depicting the manner in which each main scan line is recorded during the minor-feeding and routine feeding of the color mode.

FIG. 8 is a diagram depicting the manner in which each main scan line is recorded during the minor-feeding and routine feeding of the color mode. Constant sub-scan feeding is performed in 5-dot feed increments Sc2 while five nozzles of each color are used in step S12 (FIG. 4) following the minor-feeding in step S10. In the example in FIG. 8, the sub-scans that follow the sub-scans after the $16^{th}$ pass are based on 5-dot constant sub-scan feeding. The 5-dot constant sub-scan feeding performed during this color mode printing is referred to as the "routine feeding" of color mode printing. The main scan lines on the printing paper P can be recorded without any intervals with an ink of each color by performing such feeding.

The term "routine color mode printing" is applied to a printing procedure performed using routine feeding in step S12 while main scans color mode main scans are performed. The printing procedure for recording dots in color areas is referred to as "color mode printing." Color mode printing includes lower-edge color mode printing (see below) in addition to upper-edge color mode printing and regular color mode printing. The color mode printing is performed with the aid of a color mode unit 41*a* (see FIG. 2). The upper-edge color mode printing of step S10 is performed by the upper-edge unit 41*a*1 of the color mode unit 41*a*, whereas the routine color mode printing of step S12 is performed by a routine unit 41*a*2.

In the first working example, minor-feeding is carried out in smaller feed increments (3 dots) than the ones employed for the routine feeding of monochromatic mode printing before the transfer from monochromatic mode printing to color mode printing. For this reason, there is no need for the print head to be moved to a relative position significantly below the border between the monochromatic and color areas when an attempt is made to record main scan lines without any intervals all the way to the border between the monochromatic and color areas during monochromatic mode printing. In addition, minor-feeding is carried out in smaller feed increments (1 dot) than the ones employed for the routine feeding of color mode printing after the transfer from monochromatic mode printing to color mode printing. For this reason, there is no need to start the printing operation by placing the print head in a relative position that is significantly above the border between the monochromatic and color areas when an attempt is made to record main scan lines without any intervals all the way from the border between the monochromatic and color areas during color mode printing. It is therefore possible to make an efficient transfer from monochromatic mode printing to color mode printing without any reverse sub-scanning when the transfer from monochromatic mode printing to color mode printing is effected. In addition, the quality of the printed results can be increased in comparison with reverse sub-scanning. Although the above procedure was described as if the print head was moved during sub-scanning, this method was selected solely for the sake of simplicity and does not prevent the sub-scanning from being performed by actually moving the printing paper P when the first working example is carried out.

Another feature of routine feeding performed in each mode is that the sub-scanning is carried out in greater feed increments than the ones employed for the minor-feeding in the corresponding mode. Accordingly, the printing can be performed speedy. In addition, a position adjusting feed is performed between the minor-feeding of monochromatic mode printing and the minor-feeding of color mode printing. Images can therefore be printed with high efficiency without repeating unnecessary sub-scans or main scans after the transfer from monochromatic mode printing to color mode printing.

The black nozzles travel over the $132^{nd}$, $134^{th}$, $135^{th}$, and $138^{th}$ lines during the $10^{th}$ to $12^{th}$ passes of monochromatic mode printing (see FIG. 7). The black nozzles travel over these, main scan lines for a second time during the $13^{th}$ to $16^{th}$ passes after the system has been transferred to color mode printing (see FIGS. 7 and 8). For main scan lines over which nozzles of the same color travel a plurality of times, dots can be recorded by the nozzles that initially pass over the main scan lines, and dots can also be recorded by the nozzles that pass over the main scan lines after the system has been transferred to color mode printing. By recording dots with nozzles that initially pass over the main scan lines, it is possible to allow some time to pass until cyan, magenta, and other inks are deposited on the same pixel, thus preventing ink bleeding. In addition, recording dots with nozzles that pass over the main scan lines after the system has been transferred to color mode printing makes it possible to further reduce the number of main scans needed to record a color area. It is thus possible to reduce the decreasing of quality brought about by sub-scanning errors.

Upper-edge color mode printing in the first working example was performed in four cycles of main scanning and three cycles of minor-feeding in single-dot feed increments Sc1 from a state in which the nozzles at the lower edge of the print head were aligned with the $148^{th}$ line, as shown in FIG. 8. It is also possible, however, to start the upper-edge color mode printing from a state in which the print head is disposed above the printing paper. In other words, the relative position of the print head and printing medium at which main scan lines can be recorded without any intervals (all the way from the upper edge of the color area during upper-edge color mode printing) should be selected such that the position of the print head in relation to the printing medium is located above a specific relative position. On the other hand, performing multiple minor-feedings during upper-edge color mode printing has the danger of lowering the quality of printed results due to errors in the feed increments of sub-scans. A certain tolerance is therefore established for the relative position of the print head and printing medium when the upper-edge color mode printing is started.

Consequently, the printer should preferably be able to perform appropriate upper-edge color mode printing in accordance with individual relative positions if the relative position of the print head falls within this tolerance when the lower-edge monochromatic mode printing is completed. In the proposed printer, it is determined in step S6 (FIG. 4) whether the relative position of the print head and printing medium at the completion of lower-edge monochromatic mode printing falls within the tolerance specified for the print head and printing medium at the beginning of the upper-edge color mode printing. In the printer, a state in which the position adjusting feed of step S8 is carried out can be established if the position falls outside the tolerance. The system is transferred directly to the upper-edge color mode printing of step S10 if the position falls inside the tolerance. In the case of a transfer from the printing of a color area to the printing of a monochromatic area (see below), it is similarly determined whether the relative position reached at the completion of the lower-edge color mode printing falls within the tolerance, and a state in which a position adjusting feed is carried out can be established if the position falls outside the tolerance.

Figure 9:
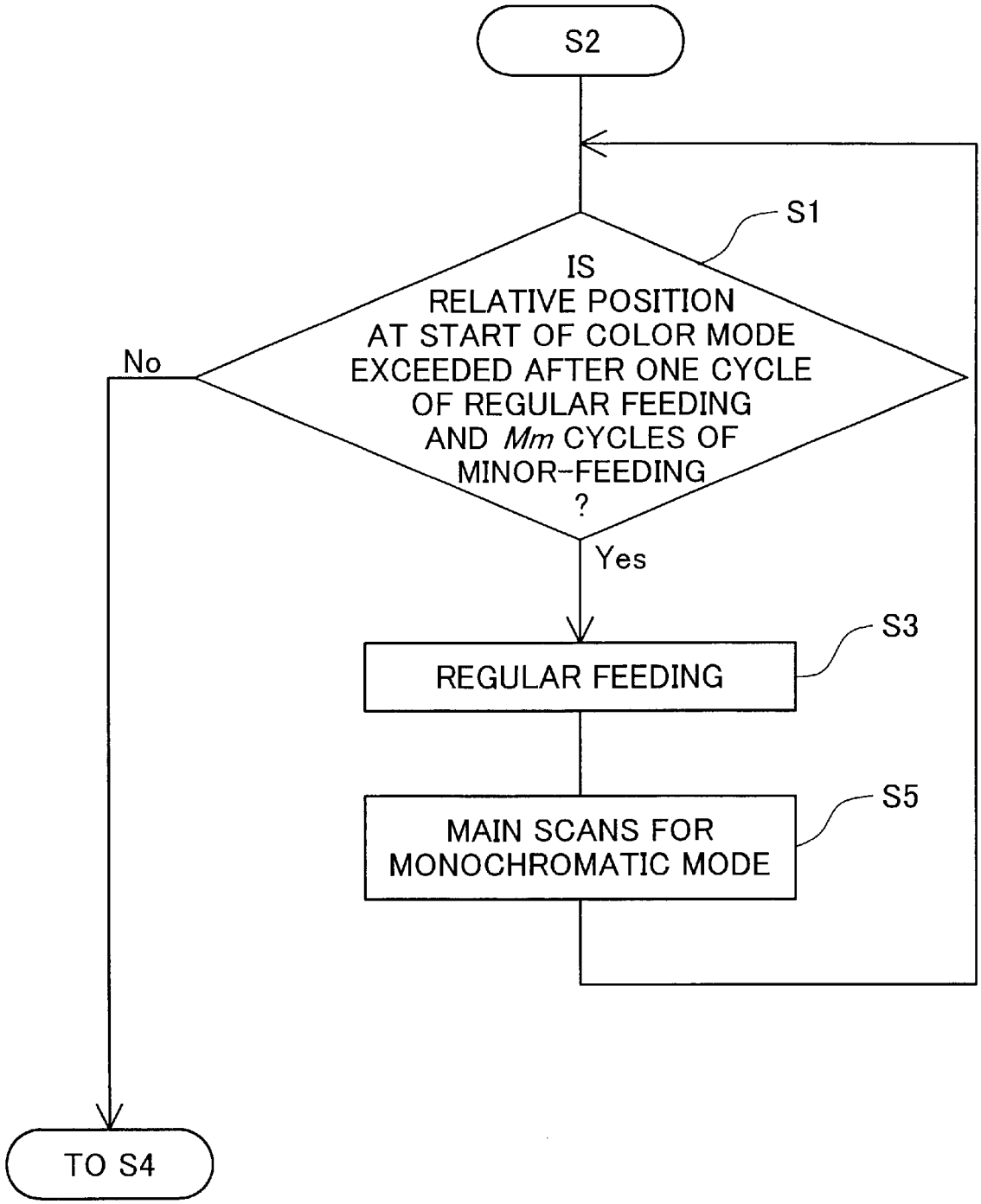
FIG. 9 is a flowchart depicting part of the procedure performed in step S2.

FIG. 9 is a flowchart depicting part of the procedure performed in step S2. If the manner in which sub-scanning is to be performed after the system is transferred to color mode printing has been established in advance, it is impossible to uniquely (irrespective of the previous steps) establish a relative position that can be selected for the print head and printing paper at the start of upper-edge color mode printing (the start of step S10 in FIG. 4) and that can be designed for recording dots on main scan lines without any intervals all the way from the upper edge of the color area. In the first working example, the relative position is such that the nozzles at the lower edge of the print head are aligned with the $148^{th}$ line, as shown in FIGS. 6 and 7. By determining the types of sub-scanning and feed increment employed for the lower-edge monochromatic mode printing (step S4 in FIG. 4), it is also possible to identify the conditions under which the transfer from step S2 to step S4 should be performed. In the first working example, three dots are selected for the feed increment of sub-scanning during lower-edge monochromatic mode printing, and seven cycles are selected for the number of sub-scans.

In step S2, it is determined whether the relative position of the print head lies beyond the relative position achieved at the beginning of the color mode, assuming a single subsequent sub-scan based on routine feeding is first performed in step S1 (FIG. 9) together with Mm cycles (where Mm is a positive integer; in the first working example, Mm is 7) of minor-feeding during lower-edge monochromatic mode printing. If the answer is negative, a subsequent cycle of sub-scanning is performed based on routine feeding in step S3, and monochromatic mode main scans are performed in step S5. The system then returns to step S1.

The operation proceeds to step S4 if it is determined in step S1 that the relative position of the print head lies beyond the relative position achieved at the start of the color mode. In the example in FIG. 6, the nozzles at the lower edge of the print head reach the $153^{rd}$ line when the fifth pass is followed by seven cycles of minor-feeding in feed increments Sm2 (each of which is equal to 3 dots) and routine feeding (sub-scanning) in feed increments Sm1 (each of which is equal to 15 dots). Since the relative position of the print head and printing paper at the start of upper-edge color mode printing is such that the nozzles at the lower edge of the print head are aligned with the $148^{th}$ line, this relative position lies beyond the relative position achieved at the start of upper-edge color mode printing. The result is that step S2 is completed and step S4 is performed after the fifth pass.

It is also possible to determine in step S1 whether the distance between the print head and the upper edge of the color area is less than a specific value by the time the lower-edge monochromatic mode printing is completed. If it is concluded that the distance is less than the specific value, sub-scanning is performed such that the print head is placed at a specific position near the upper edge of the color area. In the first working example, the specific value is Sm1+(Sm2×7) (see FIG. 6).

Although the first working example was described with reference to a case in which seven cycles of sub-scanning were performed during lower-edge monochromatic mode printing (step S4 in FIG. 4), it is also possible to use a different number of cycles. Under normal conditions, the number of sub-scanning cycles should preferably be (kc−1) or greater, where kc is the nozzle pitch of the C, M, Y, or K nozzle group. This is because the main scan lines recorded during regular monochromatic mode printing are arranged such that the main scan lines in the vicinity of the lowermost edge are recorded at an interval of (kc−1) dots. In the first working example, the nozzle pitch is equal to 4, and the $105^{th}$, $109^{th}$, $113^{th}$, and $117^{th}$ lines are recorded at a mutual interval of 3 dots in a state in which the fifth pass is completed in FIG. 6. Three or more cycles of main scanning should preferably be performed during lower-edge monochromatic mode printing in order to record the main scan lines while preserving the intervals between these lines. Another feature of the example shown in FIG. 6 is that the fourth and greater main scans (ninth and greater passes) are performed during the lower-edge monochromatic mode printing in order to record dots on the $118^{th}$ to $131^{st}$ lines, which are the lines on which no dots at all have been recorded by the time the fifth pass is completed.

(2) Transfer from Color Mode Printing to Monochromatic Mode Printing

Figure 10:
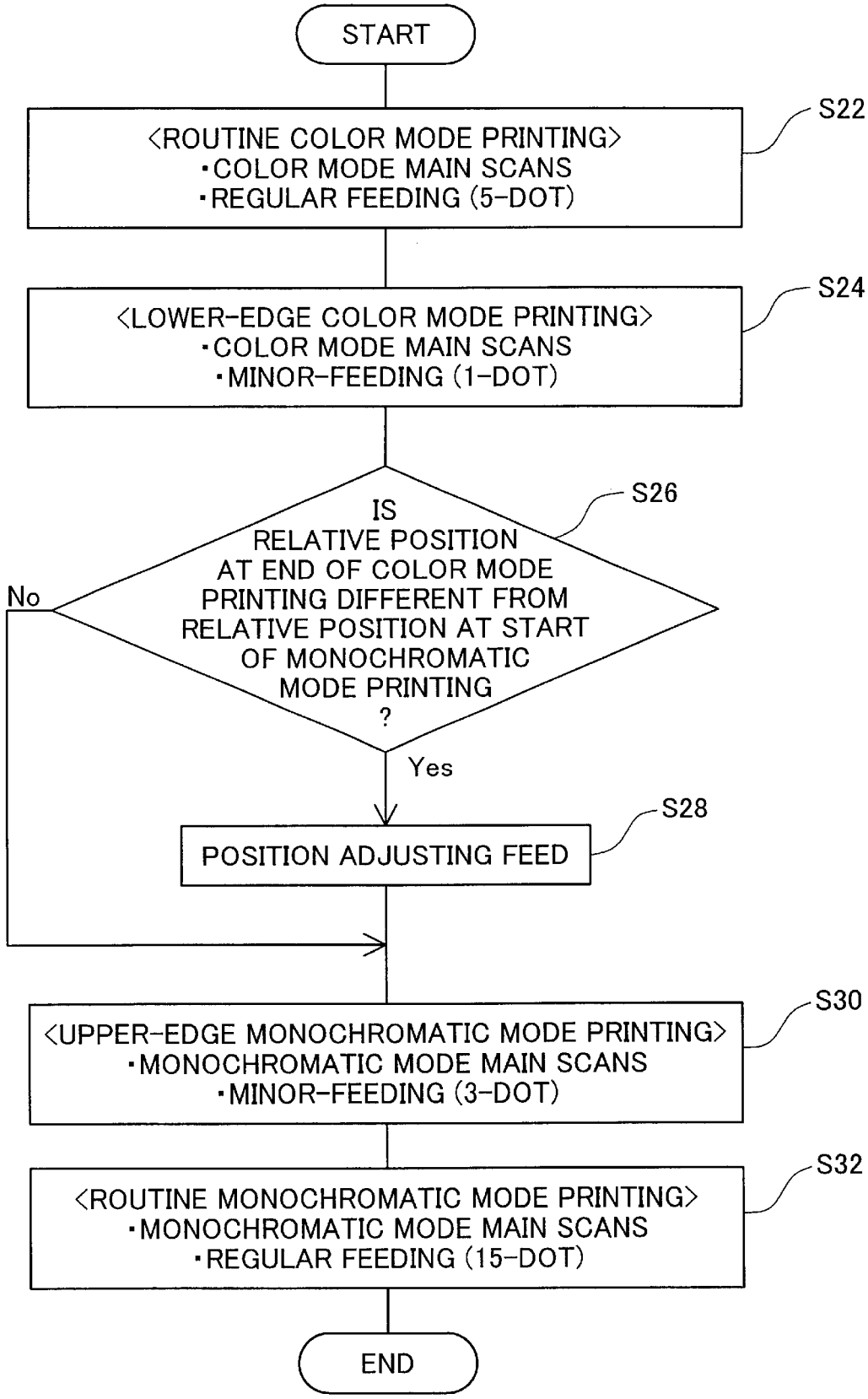
FIG. 10 is a flowchart depicting the procedure for the transfer from color mode printing to monochromatic mode printing.
Figure 11:
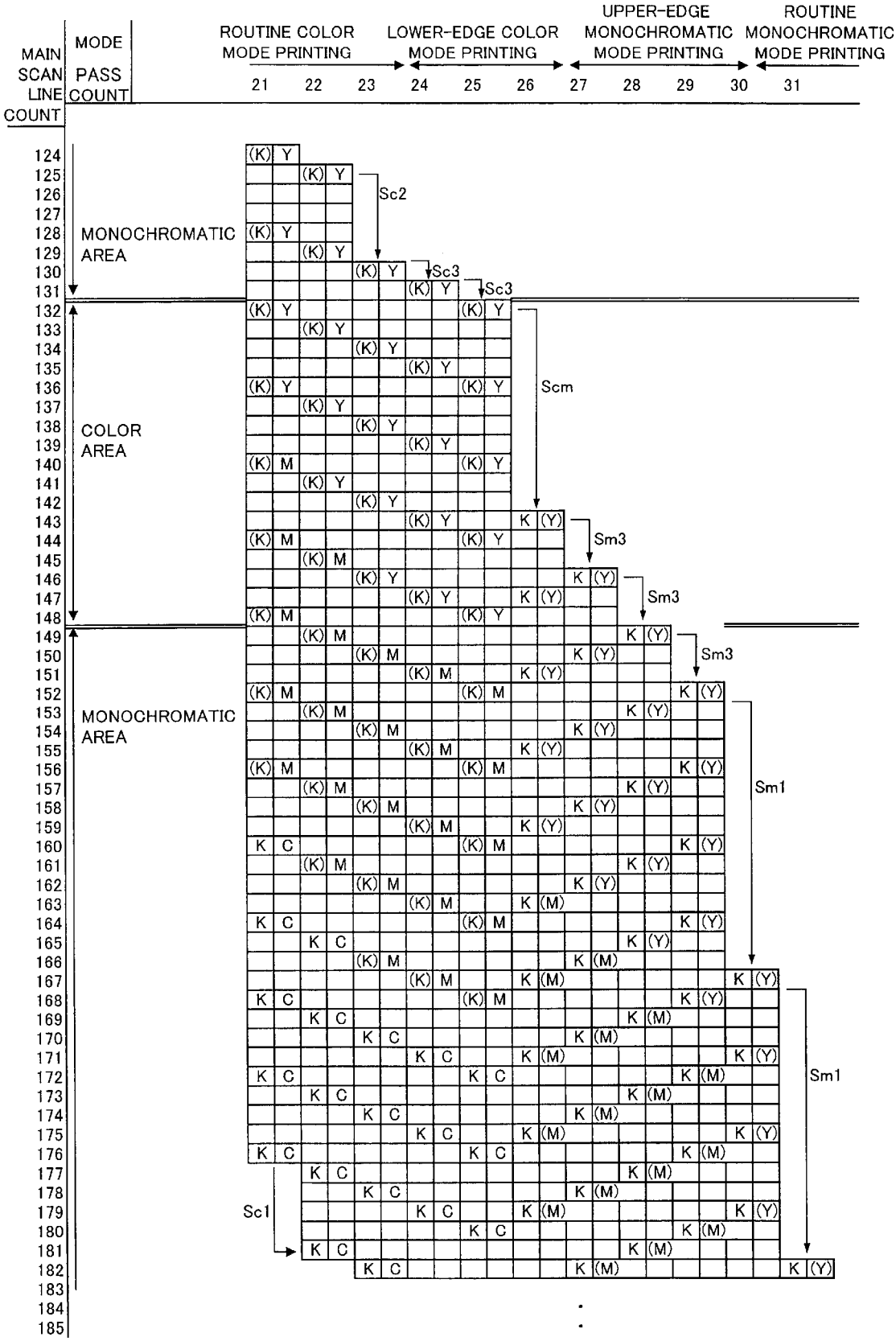
FIG. 11 is a diagram depicting the state in which each main scan line is recorded during the transfer from color mode printing to monochromatic mode printing.

FIG. 10 is a flowchart depicting the procedure for the transfer from color mode printing to monochromatic mode printing FIG. 11 is a diagram depicting the state in which each main scan line is recorded during the transfer from color mode printing to monochromatic mode printing. FIG. 11 depicts a continuation of the printing procedure shown in FIG. 8. During monochromatic mode printing, constant sub-scan feeding is performed in feed increments Sc2 (each equal to 5 dots) while color mode main scans are performed in step S22 in FIG. 10. In the examples shown in FIGS. 8 and 11, sub-scanning based on such 5-dot constant sub-scan feeding is performed from the sub-scan that follows the $16^{th}$ pass to the sub-scan that precedes the $23^{rd}$ pass. The 5-dot constant sub-scan feeding performed during color mode printing will be referred to as the "routine feeding" of color mode printing.

The color area is recorded without any intervals with magenta and cyan inks during $17^{th}$ to $23^{rd}$ passes which lie between above sub-scans. Dots are already recorded without any intervals by the black and cyan inks on the main scan lines of the color area during the $13^{th}$ to $16^{th}$ passes (see FIGS. 7 and 8). The color printing of the color area with the black, cyan, magenta, and yellow inks is therefore completed by performing the $17^{th}$ to $23^{rd}$ passes. When, however, the color area extends below the $151^{st}$ line, the interval-free recording procedure involves solely the main scan lines of the color area near the border with the monochromatic area.

After the routine feeding of step S22, constant sub-scan feeding is carried out in the 1-dot feed increments Sc3 in step S24 (FIG. 10) before the transfer from color mode printing to monochromatic mode printing. In FIG. 11, sub-scanning based on this 1-dot routine feeding extends from the sub-scans performed after the $23^{rd}$ pass to the sub-scans performed before the $25^{th}$ pass. The 1-dot constant sub-scan feeding performed during color mode printing is referred to as the "minor-feeding" of color mode printing. The term "lower-edge color mode printing" is applied to a printing procedure performed using minor-feeding in step S24 while color mode main scans are performed. The minor-feeding performed in step S24 (FIG. 10) may be the same as or different from the minor-feeding performed in step S10 in FIG. 4. The color mode printing based on the routine feeding of step S22 is performed with the aid of the routine unit 41*a*2 of the color mode unit 41*a*, whereas the color mode printing based on the minor-feeding of step S24 is performed by a lower-edge unit 41*a*3.

The transfer from step S22 to step S24 can be identified according to the same procedure as the one shown in FIG. 9 for a transfer from routine monochromatic mode printing to lower-edge monochromatic mode printing. Specifically, it is determined whether the relative position of the print head lies beyond the relative position reached at the beginning of the monochromatic mode, assuming a single subsequent sub-scan based on routine feeding is performed together with Mc cycles (where Mc is a positive integer; in the first working example, Mc is 2) of minor-feeding during lower-edge color mode printing. The transfer from step S22 to step S24 is made in case that the relative position of the print head does indeed lie beyond the relative position at the beginning of the monochromatic mode.

Following step S24 in FIG. 10, it is determined in step S26 whether a position adjusting feed is needed, and a position adjusting feed is performed in step S28 if the answer is positive. In the example shown in FIG. 11, the sub-scan performed after the $25^{th}$ pass is a position adjusting feed. The position adjusting feed has a feed increment Scm of 11 dots. This position adjusting feed is performed by a position adjusting feed unit 41*c* (see FIG. 2).

In step S26, a comparison is drawn between the relative position of the print head at the end of step S24 and the relative position of the print head at the start of upper-edge monochromatic mode printing such as the one in which main scan lines can be recorded without any intervals all the way from the upper edge of the monochromatic area during the upper-edge monochromatic mode printing described in detail below. Then it is determined whether the two positions differ from each other. In the example shown in FIG. 11, the relative position of the print head at the start of a printing operation (such as the one in which the main scan lines can be recorded without any intervals all the way from the upper edge of the monochromatic area during upper-edge monochromatic mode printing) is such that the nozzles along the upper edge of the print head are aligned with the $143^{rd}$ line. The relative position of the print head at the end of step S24, that is, at the end of the lower-edge color mode, is such that the nozzles along the upper edge are aligned with the $132^{nd}$ line. Since the two differ from each other, a position adjusting feed is performed (after the $25^{th}$ pass in the example of FIG. 11) in feed increments Scm (each equal to 11 dots) from the relative position at which the nozzles along the upper edge are aligned with the $132^{nd}$ line to the relative position at which the nozzles along the upper edge are aligned with the $143^{rd}$ line.

Monochromatic mode printing is performed during and after step S30 in FIG. 10. In the monochromatic mode printing, constant sub-scan feeding is performed in 3-dot feed increments Sm3, accompanied by monochromatic mode main scan in step S30 immediately after the transfer to a color mode. In FIG. 11, sub-scanning based on such 3-dot constant sub-scan feeding extends from the sub-scans performed after the $26^{th}$ pass to the sub-scans performed before the $29^{th}$ pass. The 3-dot constant sub-scan feeding performed in step S30 is referred to as the "minor-feeding" of monochromatic mode printing. The portion of the monochromatic area near the border with the color area is recorded with the aid of black ink without any intervals by four main scans ($26^{th}$ to $29^{th}$ passes in FIG. 11), which are performed before and after these three sub-scans. The printing operation performed in step S28 by minor-feeding (which monochromatic mode main scans are performed) is referred to as "upper-edge monochromatic mode printing." The minor-feeding performed in step S30 in FIG. 10 may be the same as or different from the minor-feeding performed in step S4 in FIG. 4.

After three cycles of minor-feeding have been performed in step S30, the routine feeding of monochromatic mode printing is carried out while nozzle Nos. 1 to 15 of the black nozzle group are used in step S32. In the example shown in FIG. 11, sub-scanning based on such routine feeding is performed during and after the sub-scan that follows the $29^{th}$ pass. The term "routine monochromatic mode printing" is applied to a printing procedure performed by carrying out routine feeding during step S32 while monochromatic mode main scans are performed. The upper-edge monochromatic mode printing of step S30 is performed by the upper-edge unit 41*b*1 of the monochromatic mode unit 41*b*, whereas the routine monochromatic mode printing of step S32 is performed by a routine unit 41*b*2.

In the first working example, 1- and 3-dot micro-feeds whose feed increments are sufficiently small in comparison with the routine feeding of each mode are performed before and after the transfer form color mode printing to monochromatic mode printing. It is therefore possible to make an efficient transfer from color mode printing to monochromatic mode printing without performing reverse sub-scanning. In addition, sub-scans whose feed increments are greater than those of minor-feeding can be performed during routine feeding in each mode. Printing can thus be accelerated.

A position adjusting feed is also performed between the minor-feeding of color mode printing and the minor-feeding of monochromatic mode printing. Printing operations can therefore be performed with high efficiency without repeating unnecessary main scans after the transfer to the monochromatic mode.

The print head of the first working example is also provided with cyan, magenta, and yellow nozzle groups in the direction of sub-scanning. The result is that when inks of each color are deposited on the same pixel, the act of deposition occurs during different main scans. Consequently, a specific time elapses between the different types of ink depositing on the pixel, making it less likely that the inks deposited on the same pixel will blend with each other. In addition, the black nozzle group is positioned in the area for accommodating the nozzle groups for the three colors (cyan, magenta, and yellow). It is therefore possible for the device to have a larger number of black nozzles in comparison with the number of nozzles contained in the cyan, magenta, and yellow groups while at the same allowing the print head to have the size necessary to accommodate the cyan, magenta, and yellow nozzle groups in the direction of main scanning. The special black nozzle group K0 is disposed in the area for accommodating the cyan nozzle group. There is, therefore, a possibility that the black ink and cyan ink will blend with each other when deposited on the same pixel. However, the quality of the print result is lowered to a lesser extent than when a black ink blends with a cyan or magenta ink.

C. Second Working Example

C1. Device Structure

Figure 12:
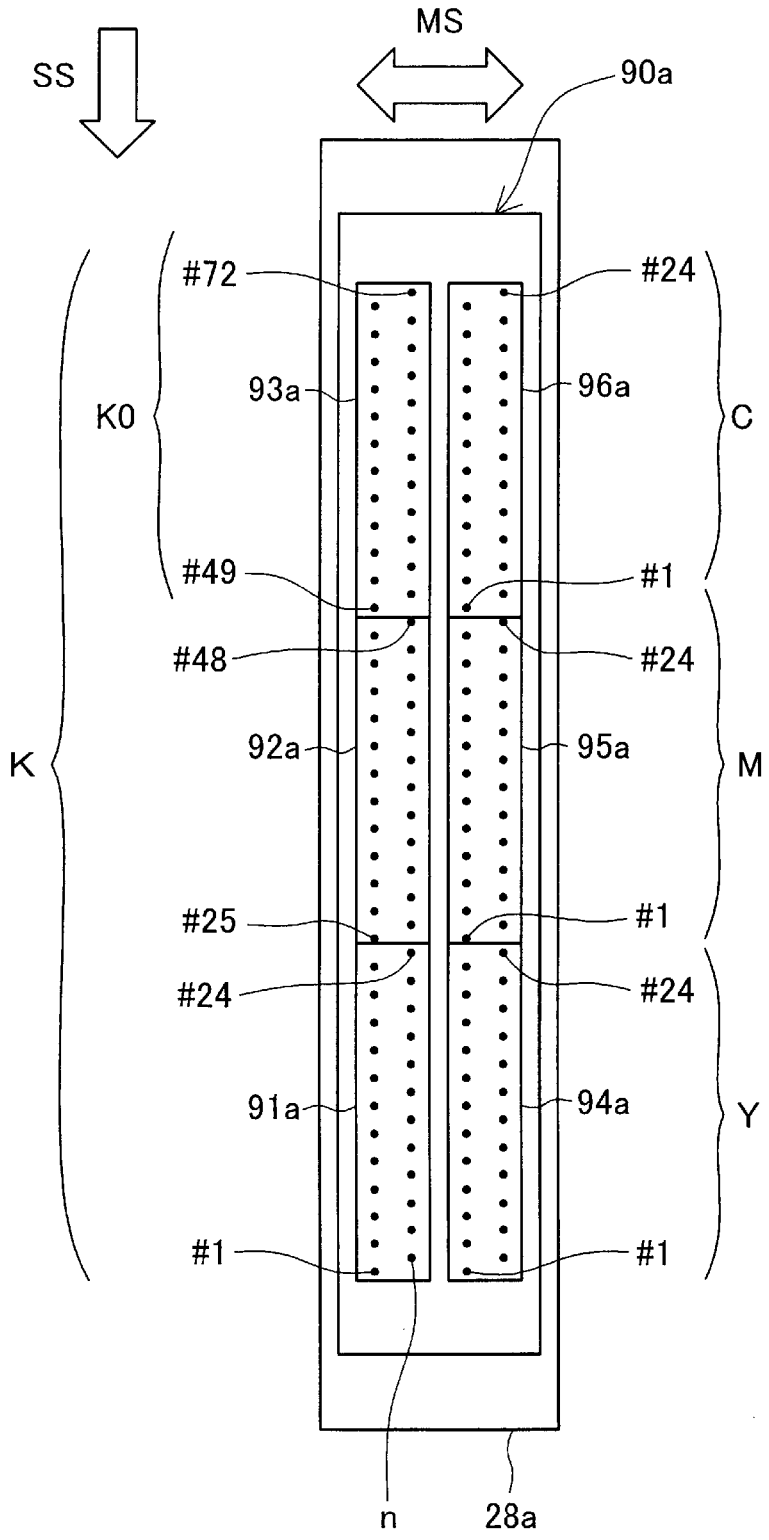
FIG. 12 is a diagram depicting a nozzle arrangement provided to the print head 28*a* of a second working example.

FIG. 12 is a diagram depicting a nozzle arrangement provided to the print head 28*a* of a second working example. The print head 28*a* of the second working example has 24 nozzles each for cyan, magenta, and yellow inks. There are also 72 nozzles for the black ink. The nozzles of each color are disposed in two columns at an 8-dot pitch in the direction of sub-scanning SS. The nozzles of each column are disposed in a so-called staggered arrangement, in which the nozzle positions alternate in the direction of sub-scanning SS. The nozzle pitch k is thus 4 dots for each color. The other device features of the printer according to the second working example are the same as those of the printer according to the first working example.

Figure 13:
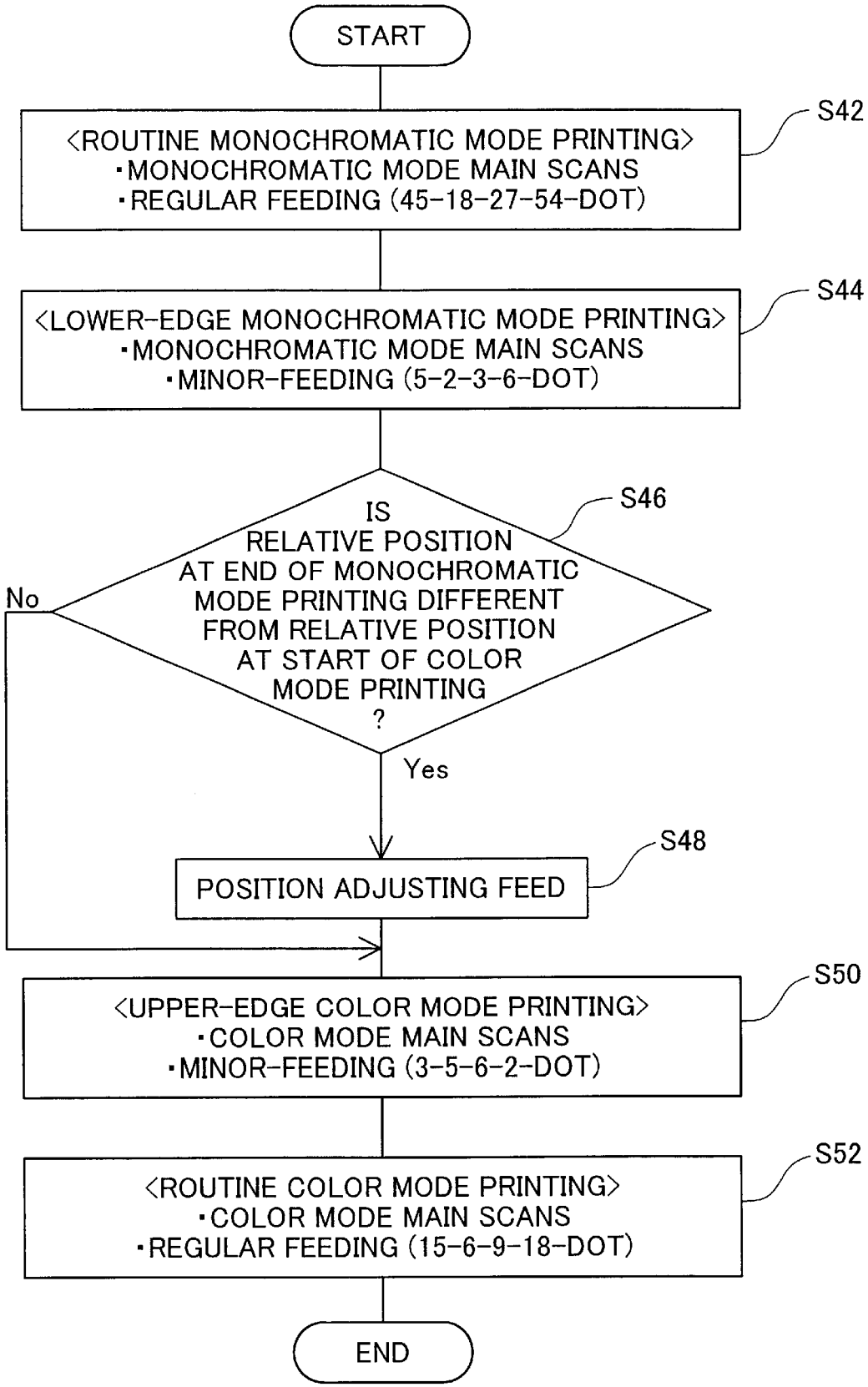
FIG. 13 is a flowchart depicting the procedure for the transfer from monochromatic mode printing to color mode printing according to a second working example.

C2. Printing (1) Transfer from Monochromatic Mode Printing to Color Mode Printing FIG. 13 is a flowchart depicting the procedure for the transfer from monochromatic mode printing to color mode printing according to the second working example. During the monochromatic mode printing according to the second working example, non-constant sub-scan feeding is performed while dots are recorded on main scans (referred to hereinbelow as the "monochromatic mode main scans" according to the second working example) with the aid of all the black nozzles (nozzle Nos. 1 to 72) in step S42 in FIG. 13. The non-constant sub-scan feeding is performed by repeating sub-scans in feed increments of 45 dots, 18 dots, 27 dots, and 54 dots. The non-constant sub-scan feeding performed in increments of 45 dots, 18 dots, 27 dots, and 54 dots during such monochromatic mode printing is referred to as the "routine feeding" of the monochromatic mode printing in accordance with the second working example. Performing feeding in this manner allows each of the main scan lines on the printing paper P to be recorded without any intervals. The quality of printed results can be improved because of the variability of the nozzle combinations for recording adjacent main scan lines. In the second working example, the term "routine monochromatic mode printing" is applied to a printing operation carried out by performing routine feeding together with the monochromatic mode main scan performed in step S42.

Non-constant sub-scan feeding is performed in step S44 in feed increments of 5 dots, 2 dots, 3 dots, and 6 dots following the routine monochromatic mode printing in step S42. The maximum feed increment (6 dots) of this non-constant sub-scan feeding is less than the maximum feed increment (54 dots) of the non-constant sub-scan feeding in step S42. The non-constant sub-scan feeding performed in increments of 5 dots, 2 dots, 3 dots, and 6 dots during such monochromatic mode printing is referred to as the "minor-feeding" of the monochromatic mode printing performed in accordance with the second working example. In the second working example, the term "lower-edge monochromatic mode printing" is applied to a printing operation carried out by performing minor-feeding accompanied by the monochromatic mode main scans performed in step S44. The monochromatic mode printing based on the routine feeding of step S42 is performed with the aid of the routine unit 41*b*2 of the monochromatic mode unit 41*b*, whereas the monochromatic mode printing based on the minor-feeding of step S44 is performed by a lower-edge unit 41*b*3.

When images are printed in large feed increments, as in the case of routine feeding by 45 dots, 18 dots, 27 dots, and 54 dots, any attempt to record dots without any intervals in a specific area (for example, in the monochromatic area extending all the way to the 131$^{st}$ line in the first working example) will create a need for the print head to be moved to a relative position significantly below the lower edge of the area. There is, however, no need for the print head to be moved to a relative position significantly below the area in which dots are to be recorded when the system is fed in small increments, as in the case of non-constant sub-scan feeding by 5 dots, 2 dots, 3 dots, and 6 dots. Such characteristics are particularly effective for printers equipped with a print head (see FIG. 12) whose nozzles are distributed widely in the direction of sub-scanning, as in the second working example.

Following step S44, it is determined if a position adjusting feed is needed in step S46, and a position adjusting feed is performed in step S48 if such a need exists. The procedures performed in steps S46 and S48 are the same as the procedures performed in steps S6 and S8 (FIG. 4). The position adjusting feed is carried out by a position adjusting feed unit 41*c* (see FIG. 2).

Color mode printing is performed during and after step S50. Nozzle Nos. 1–24 are used for cyan (C), magenta (M), and yellow (Y) during such color mode printing, and nozzle Nos. 49–72 (a total of 24 nozzles) alone are used for black (K) (see FIG. 12). The main scans performed while ink drops are ejected from these nozzles are referred to as the "color mode main scans" of the second working example. According to the second working example, nozzle Nos. 49 to 72 constitute a special black nozzle group K0.

During color mode printing, non-constant sub-scan feeding is performed in small feed increments while 24 nozzles of each color are used in step S50 immediately after the transfer from the monochromatic mode. The non-constant sub-scan feeding is performed by repeating sub-scans in feed increments of 3 dots, 5 dots, 6 dots, and 2 dots. The non-constant sub-scan feeding performed in increments of 3 dots, 5 dots, 6 dots, and 2 dots during such color mode printing is referred to as the "minor-feeding" of the color mode printing in accordance with the second working example. In the second working example, the term "upper-edge color mode printing" is applied to a printing operation carried out by performing minor-feeding accompanied by the color mode main scans performed in step S50.

When images are printed in large feed increments (such as those used for the routine feeding by 15 dots, 6 dots, 9 dots, and 18 dots described below) and an attempt is made to record dots all the way from the upper edge of a specific area (for example, a color area extending from the $132^{nd}$ line to the $148^{th}$ line in the first working example) in the direction of sub-scanning without any intervals, the print head must start printing images at a position significantly above the upper edge of this area. It is, however, possible to record dots without any intervals all the way from the upper edge of the area to be recorded even when printing is not started from a position at which the print head is significantly above the upper edge of the area, provided the feeding is done in small feed increments (such as non-constant sub-scan feeding by 3 dots, 5 dots, 6 dots, and 2 dots). Such characteristics are particularly effective for printers equipped with a print head (see FIG. 12) whose nozzles are distributed across a wide range in the direction of sub-scanning, as in the second working example.

Non-constant sub-scan feeding is performed in large feed increments while 24 nozzles of each color are used in step S52 after the minor-feeding in step S50. The non-constant sub-scan feeding is performed by repeating sub-scans in feed increments of 15 dots, 6 dots, 9 dots, and 18 dots. The maximum feed increment (18 dots) of this non-constant sub-scan feeding is greater than the maximum feed increment (6 dots) of the non-constant sub-scan feeding in step S50. The non-constant sub-scan feeding performed in increments of 15 dots, 6 dots, 9 dots, and 18 dots during such color mode printing is referred to as the "routine feeding" of the color mode printing performed in accordance with the second working example. Performing feeding in this manner allows each of the main scan lines on the printing paper P to be recorded without any intervals by the ink of each color. In the second working example, the term "routine color mode printing" is applied to a printing operation carried out by performing routine feeding accompanied by the color mode main scans performed in step S52. The color mode printing based on the minor-feeding of step S50 is performed by the upper-edge unit 41*a*1 of the color mode unit 41*a*, whereas the color mode printing based on the routine feeding of step S52 is performed by a routine unit 41*a*2.

In the second working example, a minor-feeding whose maximum feed increment is small in comparison with the routine feeding of each mode is performed before and after the transfer from monochromatic mode printing to color mode printing. It is therefore possible to make an efficient transfer from monochromatic mode printing to color mode printing. In addition, a non-constant sub-scan feeding whose maximum feed increments are large in comparison with the minor-feeding of the corresponding mode can be performed during routine feeding in each mode. Printing can thus be accelerated.

(2) Transfer from Color Mode Printing to Monochromatic Mode Printing

Figure 14:
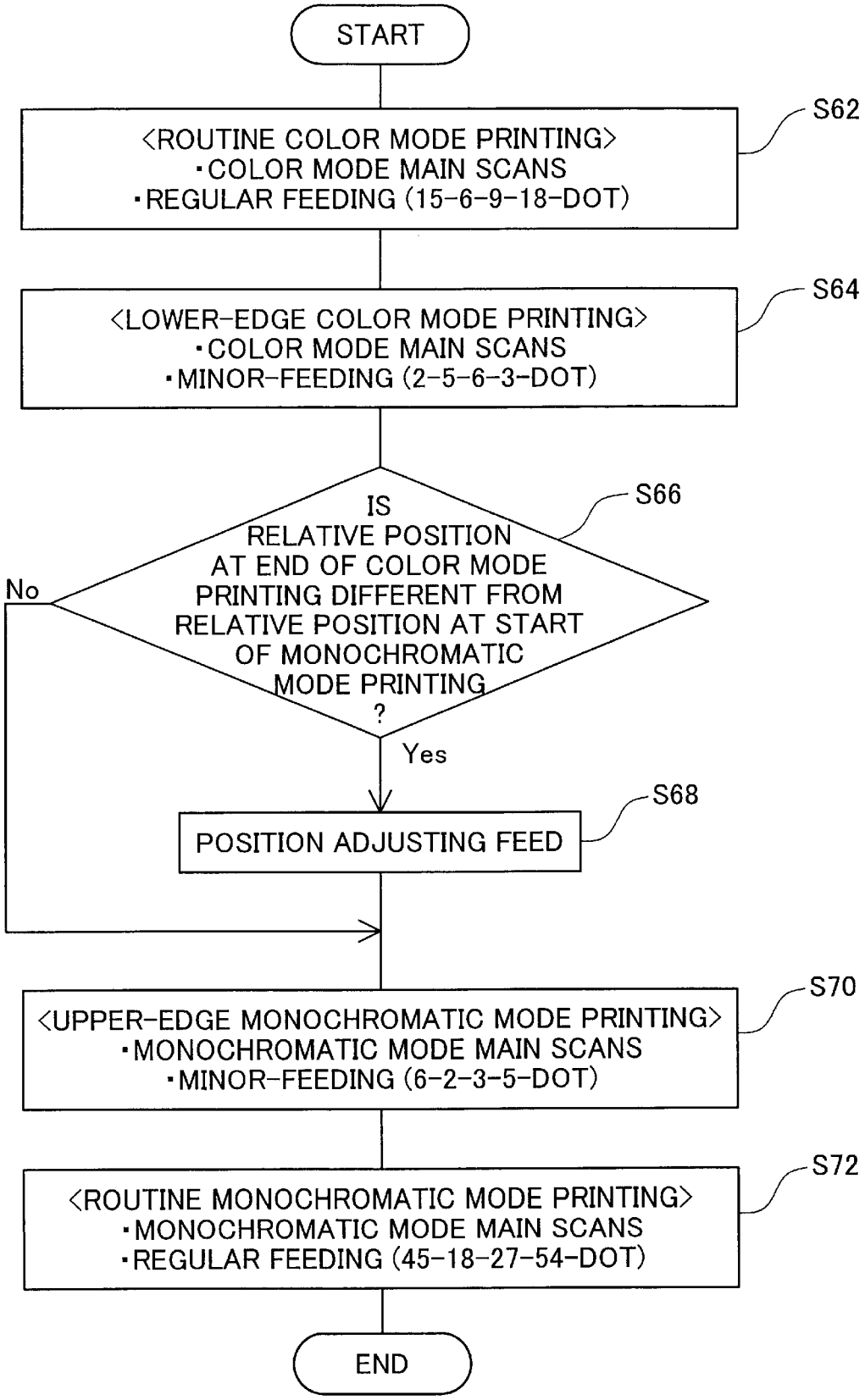
FIG. 14 is a flowchart depicting the procedure for the transfer from color mode printing to monochromatic mode printing.

FIG. 14 is a flowchart depicting the procedure for the transfer from color mode printing to monochromatic mode printing. During color mode printing, non-constant sub-scan feeding is performed while dots are recorded during main scans (referred to hereinbelow as the "color mode main scans" according to the second working example) with the aid of cyan, magenta, and yellow nozzle Nos. 1 to 24 and black nozzle Nos. 49 to 72 in step S62 (FIG. 10). The non-constant sub-scan feeding is a routine feeding performed by repeating sub-scans in feed increments of 15 dots, 6 dots, 9 dots, and 18 dots. The non-constant sub-scan feeding performed in increments of 15 dots, 6 dots, 9 dots, and 18 dots during such color mode printing is referred to as the "routine feeding" of the color mode printing in accordance with the second working example. In the second working example, the term "routine color mode printing" is applied to a printing operation carried out by performing routine feeding accompanied by the color mode main scans performed in step S62.

A non-constant sub-scan feeding in which the system is repeatedly fed by 2 dots, 5 dots, 6 dots, and 3 dots is performed in step S64 following the routine color mode printing of step S62. The non-constant sub-scan feeding performed in increments of 2 dots, 5 dots, 6 dots, and 3 dots during such color mode printing is referred to as the "minor-feeding" of the monochromatic mode printing performed in accordance with the second working example. In the second working example, the term "lower-edge color mode printing" is applied to a printing operation carried out by performing minor-feeding accompanied by the color mode main scans performed in step S64. The minor-feeding performed in step S64 (FIG. 14) may be the same as or different from the minor-feeding performed in step S50 (FIG. 13). The routing color mode printing based on step S62 is performed by the routine unit 41*a*2 of the color mode unit 41*a*, whereas the lower-edge color mode printing of step S64 is performed by a lower-edge unit 41*a*3.

Following step S64, it is determined if a position adjusting feed is needed in step S66, and a position adjusting feed is performed in step S68 if such a need exists. The procedures performed in steps S66 and S68 are the same as the procedures performed in steps S26 and S28 (FIG. 9). The position adjusting feed is carried out by a position adjusting feed unit 41*c* (see FIG. 2).

Monochromatic mode printing is performed during and after step S70. Non-constant sub-scan feeding is performed by 6 dots, 2 dots, 3 dots, and 5 dots while the monochromatic mode main scans are performed immediately after the transfer to the color mode during monochromatic mode printing. The non-constant sub-scan feeding performed in increments of 6 dots, 2 dots, 3 dots, and 5 dots in step S70 is referred to as the "minor-feeding" of monochromatic mode printing according to the second working example. In the second working example, the term "upper-edge monochromatic mode printing" is applied to a printing operation carried out by performing minor-feeding that is accompanied by the monochromatic mode main scans performed in step S70. The minor-feeding performed in step S70 may be the same as or different from the minor-feeding performed in step S44 in FIG. 13.

The routine feeding of monochromatic mode printing is performed while the monochromatic mode main scans are carried out in step S72 following the minor-feeding of step S72. The monochromatic mode printing based on the minor-feeding of step S70 is performed by the upper-edge unit 41*b*1 of the monochromatic mode unit 41*b*, whereas the monochromatic mode printing based on the routine feeding of step S72 is performed by a routine unit 41*b*2.

In the second working example, a non-constant sub-scan feeding whose maximum feed increments are small in comparison with the routine feeding of each mode is performed before and after the transfer form color mode printing to monochromatic mode printing. It is therefore possible to make an efficient transfer from color mode printing to monochromatic mode printing. In addition, a non-constant sub-scan feeding whose maximum feed increments are large in comparison with the minor-feeding of the corresponding mode can be performed during routine feeding in each mode. Printing can thus be accelerated.

D. Modification

Note that this invention is not limited by the working examples and embodiments noted above, but that in fact it is possible to implement the invention in a variety of aspects that do not stray from the scope of the key points, with a variation such as follows possible.

The above working examples were described with reference to cases in which the nozzle pitch k was 4 dots, but the nozzle pitch k is not limited to 4 and can be set at 6 dots, 8 dots, or another appropriate level. In such cases, a value constituting a prime with the nozzle pitch k of the nozzles being used should preferably be selected as the feed increment for constant sub-scan feeding. Each main scan line can thus be recorded without any intervals. In addition, the number of main scans should be set to (k−1) or greater for upper-edge and lower-edge monochromatic mode printing and upper-edge and lower-edge color mode printing. Each of the main scan lines in the vicinity of the border can thus be recorded without any intervals.

Figure 15:
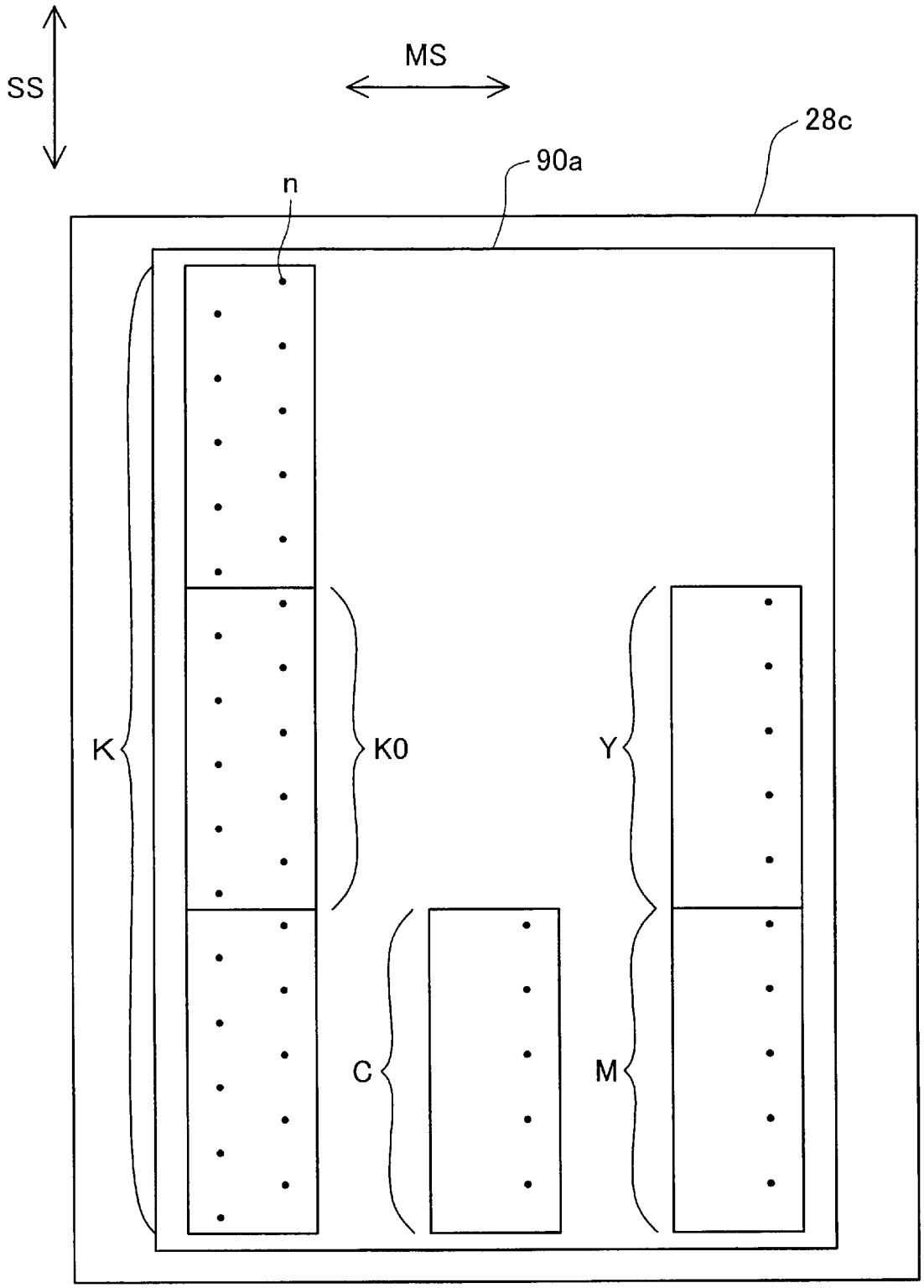
FIG. 15 is a diagram depicting a nozzle arrangement provided to the print head 28*c* according to another embodiment.
Figure 16:
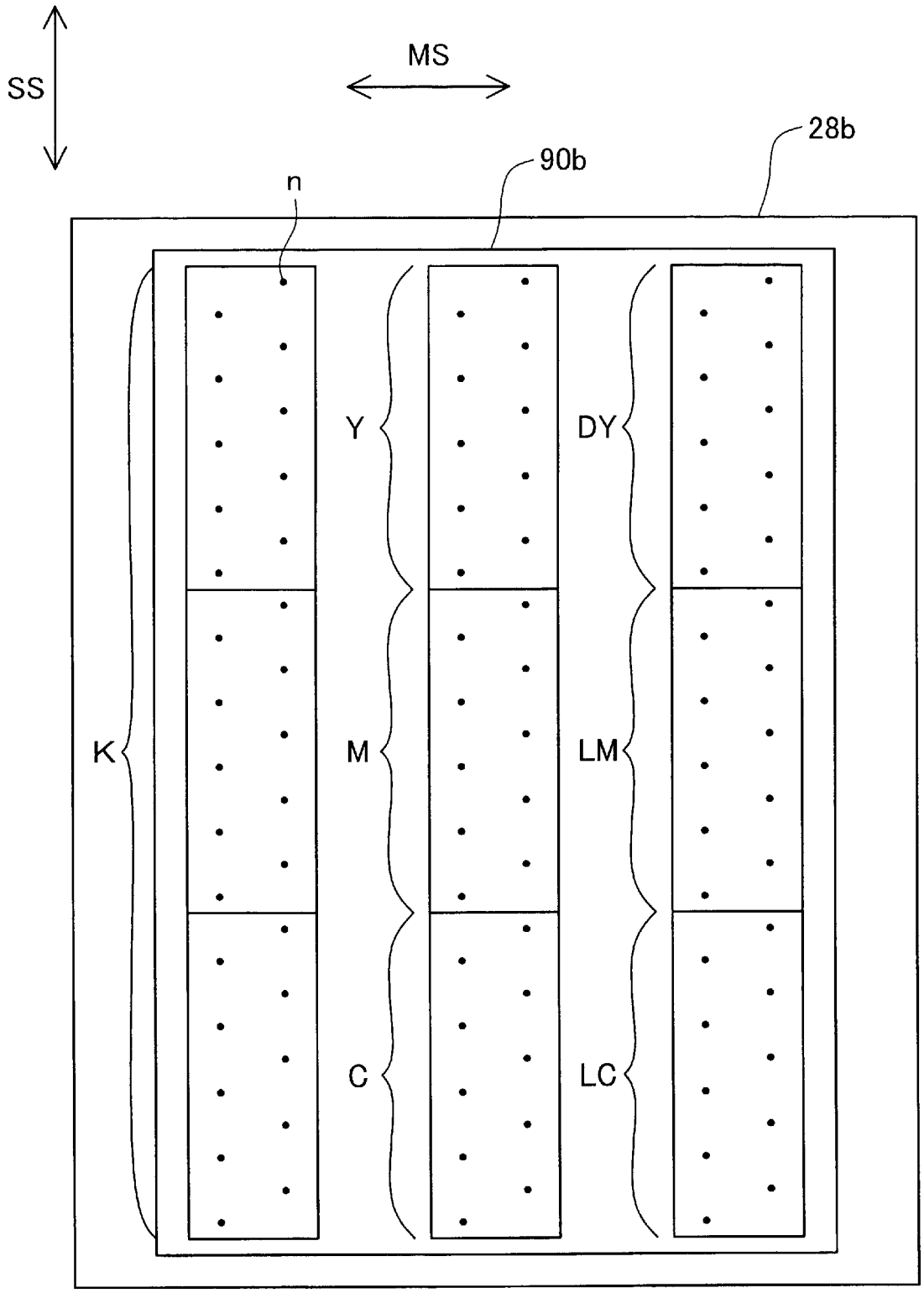
FIG. 16 is a diagram depicting a nozzle arrangement provided to the print head 28*b* according to another embodiment.

FIGS. 15 and 16 are diagrams depicting nozzle arrangements provided to the print heads 28*c* and 28*b* in accordance with other embodiments. Although the above working examples were described with reference to cases in which the nozzles of each nozzle group were arranged at the same pitch, it is also possible to arrange the nozzles of achromatic nozzle groups at a different pitch from the nozzles of single chromatic nozzle groups, as shown in FIG. 15. In such cases, the nozzles of the achromatic groups should preferably be arranged at a pitch equal to a fraction of the natural number of the nozzle pitch established for the single chromatic nozzle groups. Adopting such embodiments allows nozzles arranged at the same pitch as the single chromatic nozzle groups to be selected for the special black nozzle group K0. In the example shown in FIG. 15, the nozzles of the black nozzle group alone are staggered, and the nozzle pitch of the black nozzle group is half that of the cyan, magenta, and yellow nozzle groups. The specific black nozzle group used for color mode printing is composed of the nozzles in the intermediate portion of one column, as shown in FIG. 15.

Also, with the aforementioned working examples, the special black nozzle group K0 used for color mode printing was one group of nozzles placed at the bottom of the nozzles of black nozzle group K. However, as shown in FIG. 15, a special achromatic nozzle group can be nozzle group K0 that is placed near the center of sub-scan direction SS of the achromatic nozzle group, or can be nozzles placed in another position. Specifically, it can be a nozzle group that is part of the achromatic nozzle group and that contains the same number of nozzles as the single chromatic nozzle groups.

Although the above working examples were described with reference to cases in which columns of cyan, magenta, and yellow nozzles were aligned with each other in the direction of sub-scanning SS, it is also possible to adopt an arrangement in which the single chromatic nozzle groups are disposed at different positions in the direction of main scanning MS. It is also possible to dispense with the match between the area for accommodating achromatic nozzle groups in the direction of sub-scanning SS and the area for accommodating a plurality of single chromatic nozzle groups in the direction of sub-scanning SS. Although the above working examples were described with reference to cases in which the single chromatic nozzle groups were cyan, magenta, and yellow nozzle groups, it is also possible to adopt an arrangement in which, for example, the single chromatic nozzle groups include those that eject light cyan (LC), light magenta (LM), dark yellow (DY), and other inks, as shown in FIG. 16. Alternatively, nozzles for ejecting gray and other monochromatic inks may also be included. In other words, the term "single chromatic nozzle groups" may refer to any nozzle arrangement, any ink color, or any number of ink colors as long as these groups have mutually the same number of nozzles and are capable of ejecting mutually different inks. The inks ejected by the single chromatic nozzle groups are commonly used in color mode printing.

Although the above working examples were described with reference to cases in which achromatic nozzle groups were used to eject a black ink, it is also possible to use other arrangements in cases in which the print data contain areas to be recorded with monochromatic inks other than black, that is, arrangements in which only the inks needed to record this area are ejected from the achromatic nozzles. The achromatic nozzle groups may number two or more. In this case, each achromatic nozzle group should preferably have the same number of nozzles.

Specifically, the print head should be equipped with a plurality of single chromatic nozzle groups, each provided with mutually equal numbers of nozzles and designed for ejecting mutually different chromatic inks, and should also be equipped with achromatic nozzle groups that are designed for ejecting an achromatic ink and are provided with a greater number of nozzles in comparison with the single chromatic nozzle groups.

With each of the aforementioned working examples, we gave an explanation of an inkjet printer, but the present invention is not limited to inkjet printers, but rather can generally be applied to various printing apparatus that perform printing using printing heads. Also, the present invention is not limited to a method and device for ejecting ink drops, but can also be applied to a method or device for recording dots by other means.

With each of the aforementioned working examples, it is possible to replace part of the configuration that is realized by hardware using software, and conversely, part of the configuration that is realized using software can be replaced by hardware. For example, part of the function of head drive circuit 52 shown in FIG. 2 can be realized using software.

Although the present invention has been described and illustrated in detail, it is clearly understood that the same is by way of illustration and example only and is not to be taken by way of limitation, the spirit and scope of the present invention being limited only by the terms of the appended claims.

What we claimed is:

1. A printing method comprising the steps of:

providing a print head having a plurality of single chromatic nozzle groups for electing mutually different chromatic inks, each consisting of plurality of nozzles, and an achromatic nozzle group for ejecting achromatic ink consisting of a greater number of nozzles than each of the single chromatic nozzle groups; and printing images in a monochromatic area on a printing medium with the achromatic ink alone, and in a color area with the chromatic inks, the step of printing images comprising the steps of:

(a) executing regular monochromatic mode printing whereby sub-scans are performed in a first sub-scan mode, and dots are formed along the main scan lines in the monochromatic area;

(b) executing lower-edge monochromatic mode printing whereby sub-scans are performed in a second sub-scan mode in which a maximum sub-scan feed increment is less than a maximum sub-scan feed increment of the first sub-scan mode, and dots are formed along the main scan lines in the monochromatic area in the vicinity of a border with the color area;

(c) executing upper-edge color mode printing whereby sub-scans are performed in a third sub-scan mode, and dots are formed along the main scan lines in the color area in the vicinity of the border with the monochromatic area; and (d) executing regular color mode printing whereby sub-scans are performed in a fourth sub-scan mode in which a maximum sub-scan feed increment is greater than a maximum sub-scan feed increment of the third sub-scan mode, and dots are formed along the main scan lines in the color area.

2. The printing method according to claim 1, wherein the nozzles of the single chromatic nozzle groups are arranged at a nozzle pitch kc×D, where kc is an integer of 2 or greater and D is a pitch of main scan lines;

the nozzles of the achromatic nozzle group are arranged at a nozzle pitch km×D, where km is an integer of 2 or greater; and the printing in each of steps (a), (b), (c) and (d) is interlaced printing.

3. The printing method according to claim 1, wherein the single chromatic nozzle groups have mutually equal numbers of Nc nozzles arranged at a nozzle pitch kc×D, where Nc is an integer of 2 or greater, kc is an integer of 2 or greater and D is a pitch of main scan lines;

the achromatic nozzle group has Nm nozzles arranged at a nozzle pitch km×D, where Nm is an integer grater than Nc, km is an integer equal to kc/J and J is a positive integer; wherein step (a) comprises a step of performing monochromatic mode main scans using the achromatic nozzle group but without using the single chromatic nozzle groups, alternately with the sub-scans;

step (b) comprises a step of performing the monochromatic mode main scans at least (km−1) times alternately with the sub-scans;

step (c) comprises a step of performing color mode main scans at least (kc−1) times using the plurality of single chromatic nozzle groups and a specific achromatic nozzle group, alternately with sub-scans, the specific achromatic nozzle group being selected from the achromatic nozzle group and consisting of Nc nozzles arranged at a nozzle pitch kc×D; and step (d) comprises a step of performing color mode main scans alternately with the sub-scans.

4. The printing method according to claim 1, wherein the nozzles of the achromatic nozzle group are arranged at a nozzle pitch km×D, where km is an integer of 2 or greater; wherein step (b) comprises a step of performing the sub-scans (km−1) times.

5. The printing method according to claim 1, wherein the nozzles of the single chromatic nozzle groups are arranged at a nozzle pitch kc×D, where kc is an integer of 2 or greater; wherein step (c) comprises a step of performing the sub-scans (kc−1) times.

6. The printing method according to claim 1, wherein the step (c) comprises a step of:

starting upper-edge color mode printing when a topmost nozzle of the plurality of single chromatic nozzle groups is in a position upside of a border of the monochromatic area and the color area.

7. The printing method according to claim 1, further comprising a step of:

(e) performing a sub-scan after step (b) and before step (c) such that the print head is placed at a specific position near an upper edge of the color area when a distance between the print head and the upper edge of the color area at the end of step (b) is less than a specific value.

8. The printing method according to claim 7, wherein step (e) includes a step of:

performing a sub-scan such that the print head is put to a first relative position in relation to the printing medium from a second relative position at which the print head is located at the end of step (b), when the second relative position falls outside a permissible range of the first relative position, the first relative position being defined to be a position such that when the print head is positioned at the first relative position and step (c) is performed starting from the first relative position, the main scan lines can be recorded without any gaps all the way from the upper edge of the color area.

9. The printing method according to claim 1, wherein step (a) comprises a step of:

proceeding to step (b) if a first relative position of the print head in relation to the printing medium lies below a second relative position, the first relative position being defined to be a position reached by the print head when a subsequent sub-scan in the first sub-scan mode and all the sub-scans to be performed during step (b) are performed, the second relative position being defined to be a position such that when the print head is positioned at the second relative position and step (c) is performed starting from the second relative position, the main scan lines can be recorded without any gaps all the way from the upper edge of the color area.

10. The printing method according to claim 1, wherein the nozzles of the achromatic nozzle group are arranged at a nozzle pitch km×D, where km is an integer of 2 or greater and D is a pitch of main scan lines; and the first sub-scan mode is a mode for carrying out a constant sub-scan feeding with constant feed increments of p1×D, where p1 is an integer constituting a prime with km.

11. The printing method according to claim 1, wherein the first sub-scan mode is a mode for carrying out a non-constant sub-scan feeding that includes performing repeated combinations of sub-scans in variable feed increments.

12. The printing method according to claim 1, wherein the nozzles of the single chromatic nozzle groups are arranged at a nozzle pitch kc×D, where kc is an integer of 2 or greater and D is a pitch of main scan lines; and the fourth sub-scan mode is a mode for carrying out a constant sub-scan feeding with constant feed increments of q1×D, where q1 is an integer constituting a prime with kc.

13. The printing method according to claim 1, wherein the fourth sub-scan mode is a mode for carrying out a non-constant sub-scan feeding that includes performing repeated combinations of sub-scans in variable feed increments.

14. The printing method according to claim 1, wherein the nozzles of the achromatic nozzle group are arranged at a nozzle pitch km×D, where km is an integer of 2 or greater and D is a pitch of main scan lines; and the second sub-scan mode is a mode for carrying out a constant sub-scan feeding with constant feed increments of p2×D, where p2 is an integer constituting a prime with km.

15. The printing method according to claim 1, wherein the nozzles of the single chromatic nozzle groups are arranged at a nozzle pitch kc×D, where kc is an integer of 2 or greater and D is a pitch of main scan lines; and the third sub-scan mode is a mode for carrying out a constant sub-scan feeding with constant feed increments of q2×D, where q2 is an integer constituting a prime with kc.

16. The printing method according to claim 15, wherein q2 is 1.

17. A printing method comprising the steps of:

providing a print head having a plurality of single chromatic nozzle groups for ejecting mutually different chromatic inks, each consisting of plurality of nozzles, and an achromatic nozzle group for ejecting achromatic ink consisting of a greater number of nozzles than each of the single chromatic nozzle groups; and printing images in a monochromatic area on a printing medium with the achromatic ink alone, and in a color area with the chromatic inks, the step of printing images comprising the steps of:

(a) executing regular color mode printing whereby sub-scans are performed in a first sub-scan mode, and dots are formed along the main scan lines in the color area;

(b) executing lower-edge color mode printing whereby sub-scans are performed in a second sub-scan mode in which a maximum sub-scan feed increment is less than a maximum sub-scan feed increment of the first sub-scan mode, and dots are formed along the main scan lines in the color area in the vicinity of the border with the monochromatic area;

(c) executing upper-edge monochromatic mode printing whereby sub-scans are performed in a third sub-scan mode, and dots are formed along the main scan lines in the monochromatic area in the vicinity of a border with the color area; and (d) executing regular monochromatic mode printing whereby sub-scans are performed in a fourth sub-scan mode in which a maximum sub-scan feed increment is greater than a maximum sub-scan feed increment of the third sub-scan mode, and dots are formed along the main scan lines in the monochromatic area.

18. The printing method according to claim 17, wherein the nozzles of the single chromatic nozzle groups are arranged at a nozzle pitch kc×D, where kc is an integer of 2 or greater and D is a pitch of main scan lines;

the nozzles of the achromatic nozzle group are arranged at a nozzle pitch km×D, where km is an integer of 2 or greater; and the printing in each of steps (a), (b), (c) and (d) is interlaced printing.

19. The printing method according to claim 17, wherein the single chromatic nozzle groups have mutually equal numbers of Nc nozzles arranged at a nozzle pitch kc×D, where Nc is an integer of 2 or greater, kc is an integer of 2 or greater and D is a pitch of main scan lines;

the achromatic nozzle group has Nm nozzles arranged at a nozzle pitch km×D, where Nm is an integer grater than Nc, km is an integer equal to kc/J and J is a positive integer; wherein step (a) comprises a step of performing color mode main scans using the plurality of single chromatic nozzle groups and specific achromatic nozzle group, alternately with the sub-scans, the specific achromatic nozzle group being selected from the achromatic nozzle group and consisting of Nc nozzles arranged at a nozzle pitch kc×D;

step (b) comprises a step of performing the color mode main scans at least (kc−1) times alternately with the sub-scans;

step (c) comprises a step of performing monochromatic mode main scans at least (km−1) times using the achromatic nozzle group but without using the single chromatic nozzle groups, alternately with sub-scans; and step (d) comprises a step of performing the monochromatic mode main scans alternately with the sub-scans.

20. The printing method according to claim 17, wherein the nozzles of the single chromatic nozzle groups are arranged at a nozzle pitch kc×D, where kc is an integer of 2 or greater; wherein step (b) comprises a step of performing the sub-scans (kc−1) times.

21. The printing method according to claim 17, wherein the nozzles of the achromatic nozzle group are arranged at a nozzle pitch km×D, where km is an integer of 2 or greater; wherein step (c) comprises a step of performing the sub-scans (km−1) times.

22. The printing method according to claim 17, wherein the step (c) comprises a step of:

starting upper-edge monochromatic mode printing when a topmost nozzle of the achromatic nozzle group is in a position upside of a border of the color area and the monochromatic area.

23. The printing method according to claim 17, comprising a step of:

(e) performing a sub-scan after step (b) and before step (c) such that the print head is placed at a specific position near an upper edge of the monochromatic area when a distance between the print head and the upper edge of the monochromatic area at the end of step (b) is less than a specific value.

24. The printing method according to claim 23, wherein step (e) includes a step of:

performing a sub-scan such that the print head is put to a first relative position in relation to the printing medium from a second relative position at which the print head is located at the end of step (b), when the second relative position falls outside a permissible range of the first relative position, the first relative position being defined to be a position such that when the print head is positioned at the first relative position and step (c) is performed starting from the first relative position, the main scan lines can be recorded without any gaps all the way from the upper edge of the monochromatic area.

25. The printing method according to claim 17, wherein step (a) comprises a step of:

proceeding to step (b) if a first relative position of the print head in relation to the printing medium lies below a second relative position, the first relative position being defined to be a position reached by the print head when a subsequent sub-scan in the first sub-scan mode and all the sub-scans to be performed during step (b) are performed, the second relative position being defined to be a position such that when the print head is positioned at the second relative position and step (c) is performed starting from the second relative position, the main scan lines can be recorded without any gaps all the way from the upper edge of the monochromatic area.

26. The printing method according to claim 17, wherein the nozzles of the single chromatic nozzle groups are arranged at a nozzle pitch kc×D, where kc is an integer of 2 or greater and D is a pitch of main scan lines; and the first sub-scan mode is a mode for carrying out a constant sub-scan feeding with constant feed increments of q1×D, where q1 is an integer constituting a prime with kc.

27. The printing method according to claim 17, wherein the first sub-scan mode is a mode for carrying out a non-constant sub-scan feeding that includes performing repeated combinations of sub-scans in variable feed increments.

28. The printing method according to claim 17, wherein the nozzles of the achromatic nozzle group are arranged at a nozzle pitch km×D, where km is an integer of 2 or greater and D is a pitch of main scan lines; and the fourth sub-scan mode is a mode for carrying out a constant sub-scan feeding with constant feed increments of p1×D, where p1 is an integer constituting a prime with km.

29. The printing method according to claim 17, wherein the fourth sub-scan mode is a mode for carrying out a non-constant sub-scan feeding that includes performing repeated combinations of sub-scans in variable feed increments.

30. The printing method according to claim 17, wherein the nozzles of the single chromatic nozzle groups are arranged at a nozzle pitch kc×D, where kc is an integer of 2 or greater and D is a pitch of main scan lines; and the second sub-scan mode is a mode for carrying out a constant sub-scan feeding with constant feed increments of q2×D, where q2 is an integer constituting a prime with kc.

31. The printing method according to claim 30, wherein q2 is 1.

32. The printing method according to claim 17, wherein the nozzles of the achromatic nozzle group are arranged at a nozzle pitch km×D, where km is an integer of 2 or greater and D is a pitch of main scan lines; and the third sub-scan mode is a mode for carrying out a constant sub-scan feeding with constant feed increments of p2×D, where p2 is an integer constituting a prime with km.

33. A printing apparatus which prints images in a monochromatic area on a printing medium with an achromatic ink alone, and in a color area with chromatic inks, by ejecting ink drops from a nozzle to deposit the ink drops on the printing medium to form dots, comprising:

a printing head having:

a plurality of single chromatic nozzle groups for ejecting mutually different chromatic inks each consisting of plurality of nozzles, and an achromatic nozzle group for ejecting achromatic ink consisting of a greater number of nozzles than each of the single chromatic nozzle groups;

a main scan drive unit that moves at least one of the printing head and the printing medium to perform main scanning;

a sub-scan drive unit that moves at least one of the printing head and the printing medium in a direction that intersects a main scanning direction to perform sub-scanning; and a control unit that controls the printing head, the main scan drive unit and the sub-scan drive unit, wherein the control unit has:

(a) a regular monochromatic mode unit that executes regular monochromatic mode printing whereby sub-scans are performed in a first sub-scan mode, and dots are formed along the main scan lines in the monochromatic area;

(b) a lower-edge monochromatic mode unit that executes lower-edge monochromatic mode printing whereby sub-scans are performed in a second sub-scan mode in which a maximum sub-scan feed increment is less than a maximum sub-scan feed increment of the first sub-scan mode, and dots are formed along the main scan lines in the monochromatic area in the vicinity of a border with the color area;

(c) a upper-edge color mode unit that executes upper-edge color mode printing whereby sub-scans are performed in a third sub-scan mode, and dots are formed along the main scan lines in the color area in the vicinity of the border with the monochromatic area; and (d) a regular color mode unit that executes regular color mode printing whereby sub-scans are performed in a fourth sub-scan mode in which a maximum sub-scan feed increment is greater than a maximum sub-scan feed increment of the third sub-scan mode, and dots are formed along the main scan lines in the color area.

34. The printing apparatus according to claim 33, wherein the nozzles of the single chromatic nozzle groups are arranged at a nozzle pitch kc×D, where kc is an integer of 2 or greater and D is a pitch of main scan lines;

the nozzles of the achromatic nozzle group are arranged at a nozzle pitch km×D, where km is an integer of 2 or greater; and the regular monochromatic mode unit, the lower-edge monochromatic mode unit, the upper-edge color mode unit and the regular color mode unit each executes interlaced printing.

35. The printing apparatus according to claim 33, wherein the single chromatic nozzle groups have mutually equal numbers of Nc nozzles arranged at a nozzle pitch kc×D, where Nc is an integer of 2 or greater, kc is an integer of 2 or greater and D is a pitch of main scan lines;

the achromatic nozzle group has Nm nozzles arranged at a nozzle pitch km×D, where Nm is an integer grater than Nc, km is an integer equal to kc/J and J is a positive integer; wherein the regular monochromatic mode unit performs monochromatic mode main scans using the achromatic nozzle group but without using the single chromatic nozzle groups, alternately with the sub-scans;

the lower-edge monochromatic mode unit performs the monochromatic mode main scans at least (km−1) times alternately with the sub-scans;

the upper-edge color mode unit performs color mode main scans at least (kc−1) times using the plurality of single chromatic nozzle groups and a specific achromatic nozzle group, alternately with sub-scans, the specific achromatic nozzle group being selected from the achromatic nozzle group and consisting of Nc nozzles arranged at a nozzle pitch kc×D; and the regular color mode unit performs color mode main scans alternately with the sub-scans.

36. The printing apparatus according to claim 35, wherein the plurality of single chromatic nozzle groups comprise:

a cyan nozzle group for ejecting a cyan ink;

a magenta nozzle group for ejecting a magenta ink; and a yellow nozzle group for ejecting a yellow ink, the cyan nozzle group, magenta nozzle group, and yellow nozzle group are disposed in the order indicated in the direction of sub-scanning;

the achromatic nozzle group are equipped with Nc×3 nozzles arranged at a nozzle pitch kc×D and are disposed in the area for accommodating the nozzles cyan nozzle group, magenta nozzle group, and yellow nozzle group; and the specific achromatic nozzle group is disposed in the area for accommodating the nozzles of the cyan nozzle group in the direction of sub-scanning.

37. The printing apparatus according to claim 33, wherein the nozzles of the achromatic nozzle group are arranged at a nozzle pitch km×D, where km is an integer of 2 or greater; wherein the lower-edge monochromatic mode unit performs the sub-scans (km−1) times.

38. The printing apparatus according to claim 33, wherein the nozzles of the single chromatic nozzle groups are arranged at a nozzle pitch kc×D, where kc is an integer of 2 or greater; wherein the upper-edge color mode unit performs the sub-scans (kc−1) times.

39. The printing apparatus according to claim 33, wherein the upper-edge color mode unit starts upper-edge color mode printing when a topmost nozzle of the plurality of single chromatic nozzle groups is in a position upside of a border of the monochromatic area and the color area.

40. The printing apparatus according to claim 33, wherein the control unit further comprises:

a position adjusting feed unit that performs a sub-scan such that the print head is placed at a specific position near an upper edge of the color area when a distance between the print head and the upper edge of the color area at the end of lower-edge monochromatic mode printing is less than a specific value.

41. The printing apparatus according to claim 40, wherein the position adjusting feed unit performs the sub-scan such that the print head is put to a first relative position in relation to the printing medium from a second relative position at which the print head is located at the end of lower-edge monochromatic mode printing, when the second relative position falls outside a permissible range of the first relative position, the first relative position being defined to be a position such that when the print head is positioned at the first relative position at the end of lower-edge monochromatic mode printing and upper-edge color mode printing is performed starting from the first relative position, the main scan lines can be recorded without any gaps all the way from the upper edge of the color area.

42. The printing apparatus according to claim 33, wherein the regular monochromatic mode unit proceeds to lower-edge monochromatic mode printing in case that a first relative position of the print head in relation to the printing medium, assuming that a subsequent sub-scan based on the first sub-scan mode and all the sub-scans to be performed during lower-edge monochromatic mode printing are performed, lies below a second relative position of the print head in relation to the printing medium in which the main scan lines can be recorded without any intervals all the way from the upper edge of the color area, assuming that upper-edge color mode printing is performed starting from the first relative position.

43. A printing apparatus which prints images in a monochromatic area on a printing medium with an achromatic ink alone, and in a color area with chromatic inks, by ejecting ink drops from a nozzle to deposit the ink drops on the printing medium to form dots, comprising:

a printing head having:

a plurality of single chromatic nozzle groups for ejecting mutually different chromatic inks, each consisting of plurality of nozzles, and an achromatic nozzle group for ejecting achromatic ink consisting of a greater number of nozzles than each of the single chromatic nozzle groups;

a main scan drive unit that moves at least one of the printing head and the printing medium to perform main scanning;

a sub-scan drive unit that moves at least one of the printing head and the printing medium in a direction that intersects a main scanning direction to perform sub-scanning; and a control unit that controls the printing head, the main scan drive unit and the sub-scan drive unit, wherein the control unit has:

(a) a regular color mode unit that executes regular color mode printing whereby sub-scans are performed in a first sub-scan mode, and dots are formed along the main scan lines in the color area;

(b) a lower-edge color mode unit that executes lower-edge color mode printing whereby sub-scans are performed in a second sub-scan mode in which a maximum sub-scan feed increment is less than a maximum sub-scan feed increment of the first sub-scan mode, and dots are formed along the main scan lines in the color area in the vicinity of the border with the monochromatic area;

(c) a upper-edge monochromatic mode unit that executes upper-edge monochromatic mode printing whereby sub-scans are performed in a third sub-scan mode, and dots are formed along the main scan lines in the monochromatic area in the vicinity of a border with the color area; and (d) a regular monochromatic mode unit that executes regular monochromatic mode printing whereby sub-scans are performed in a fourth sub-scan mode in which a maximum sub-scan feed increment is greater than a maximum sub-scan feed increment of the third sub-scan mode, and dots are formed along the main scan lines in the monochromatic area.

44. The printing apparatus according to claim 43, wherein the nozzles of the single chromatic nozzle groups are arranged at a nozzle pitch kc×D, where kc is an integer of 2 or greater and D is a pitch of main scan lines;

the nozzles of the achromatic nozzle group are arranged at a nozzle pitch km×D, where km is an integer of 2 or greater; and the regular color mode unit, the lower-edge color mode unit, the upper-edge monochromatic mode unit and the regular monochromatic mode unit each executes interlaced printing.

45. The printing apparatus according to claim 44, wherein the single chromatic nozzle groups have mutually equal numbers of Nc nozzles arranged at a nozzle pitch kc×D, where Nc is an integer of 2 or greater, kc is an integer of 2 or greater and D is a pitch of main scan lines;

the achromatic nozzle group has Nm nozzles arranged at a nozzle pitch km×D, where Nm is an integer grater than Nc, km is an integer equal to kc/J and J is a positive integer; wherein the regular color mode unit performs color mode main scans using the plurality of single chromatic nozzle groups and specific achromatic nozzle group alternately with the sub-scans, the specific achromatic nozzle group being selected from the achromatic nozzle group and consisting of Nc nozzles arranged at a nozzle pitch kc×D;

the lower-edge color mode unit performs the color mode main scans at least (kc−1) times alternately with the sub-scans;

the upper-edge monochromatic mode unit performs monochromatic mode main scans using the achromatic nozzle group but without using the single chromatic nozzle groups at least (km−1) times alternately with sub-scans; and the regular monochromatic mode unit performs the monochromatic mode main scans alternately with the sub-scans.

46. The printing apparatus according to claim 45, wherein the plurality of single chromatic nozzle groups comprise:

a cyan nozzle group for ejecting a cyan ink;

a magenta nozzle group for ejecting a magenta ink; and a yellow nozzle group for ejecting a yellow ink, the cyan nozzle group, magenta nozzle group, and yellow nozzle group are disposed in the order indicated in the direction of sub-scanning;

the achromatic nozzle group are equipped with Nc×3 nozzles arranged at a nozzle pitch kc×D and are disposed in the area for accommodating the nozzles cyan nozzle group, magenta nozzle group, and yellow nozzle group; and the specific achromatic nozzle group is disposed in the area for accommodating the nozzles of the cyan nozzle group in the direction of sub-scanning.

47. The printing apparatus according to claim 43, wherein the nozzles of the single chromatic nozzle groups are arranged at a nozzle pitch kc×D, where kc is an integer of 2 or greater; wherein the lower-edge color mode unit performs the sub-scans (kc−1) times.

48. The printing apparatus according to claim 43, wherein the nozzles of the achromatic nozzle group are arranged at a nozzle pitch km×D, where km is an integer of 2 or greater; wherein the upper-edge monochromatic mode unit performs the sub-scans (km−1) times.

49. The printing apparatus according to claim 43, wherein the upper-edge monochromatic mode unit starts upper-edge monochromatic mode printing when a topmost nozzle of the achromatic nozzle group is in a position upside of a border of the color area and the monochromatic area.

50. The printing apparatus according to claim 43, wherein the control unit further comprises:

a position adjusting feed unit that performs a sub-scan whereby the print head is placed at a specific position near an upper edge of the monochromatic area when the distance between the print head and the upper edge of the monochromatic area at the end of lower-edge color mode printing is less than a specific value.

51. The printing apparatus according to claim 50, wherein the position adjusting feed unit performs the sub-scan from a second relative position of the print head in relation to the printing medium to a first relative position of the print head in relation to the printing medium, when the second relative position at the end of lower-edge color mode printing falls outside an allowed range of the first relative position in which the main scan lines can be monochromatic area, assuming that upper-edge monochromatic mode printing is performed starting from the first relative position.

52. The printing apparatus according to claim 43, wherein the regular color mode unit proceeds to lower-edge color mode printing in case that a first relative position of the print head in relation to the printing medium, assuming that a subsequent sub-scan based on the first sub-scan mode and all the sub-scans to be performed during lower-edge color mode printing are performed, lies below a second relative position of the print head in relation to the printing medium in which the main scan lines can be recorded without any intervals all the way from the upper edge of the monochromatic area, assuming that upper-edge monochromatic mode printing is performed starting from the second relative position.

53. A computer program product for printing images in a monochromatic area on a printing medium with the achromatic ink alone, and in a color area with the chromatic inks, using a computer, the computer being connected with a printing device having a printing head equipped with a plurality of single chromatic nozzle groups for ejecting mutually different chromatic inks, each consisting of plurality of nozzles, and an achromatic nozzle group for ejecting achromatic ink consisting of a greater number of nozzles than each of the single chromatic nozzle groups, the computer program product comprising:

a computer readable medium; and a computer program stored on the computer readable medium, the computer program comprising:

(a) a regular monochromatic mode program for causing the computer to execute regular monochromatic mode printing whereby sub-scans are performed in a first sub-scan mode, and dots are formed along the main scan lines in the monochromatic area;

(b) a lower-edge monochromatic mode program for causing the computer to execute lower-edge monochromatic mode printing whereby sub-scans are performed in a second sub-scan mode in which a maximum sub-scan feed increment is less than a maximum sub-scan feed increment of the first sub-scan mode, and dots are formed along the main scan lines in the monochromatic area in the vicinity of a border with the color area;

(c) a upper-edge color mode program for causing the computer to execute upper-edge color mode printing whereby sub-scans are performed in a third sub-scan mode, and dots are formed along the main scan lines in the color area in the vicinity of the border with the monochromatic area; and (d) a regular color mode program for causing the computer to execute regular color mode printing whereby sub-scans are performed in a fourth sub-scan mode in which a maximum sub-scan feed increment is greater than a maximum sub-scan feed increment of the third sub-scan mode, and dots are formed along the main scan lines in the color area.

54. A computer program product for printing images in a monochromatic area on a printing medium with the achromatic ink alone, and in a color area with the chromatic inks, using a computer, the computer being connected with a printing device having a printing head equipped with a plurality of single chromatic nozzle groups for ejecting mutually different chromatic inks, each consisting of plurality of nozzles, and an achromatic nozzle group for ejecting achromatic ink consisting of a greater number of nozzles than each of the single chromatic nozzle groups, the computer program product comprising:

a computer readable medium; and a computer program stored on the computer readable medium, the computer program comprising:

(a) a regular color mode program for causing the computer to execute regular color mode printing whereby sub-scans are performed in a first sub-scan mode, and dots are formed along the main scan lines in the color area;

(b) a lower-edge color mode program for causing the computer to execute lower-edge color mode printing whereby sub-scans are performed in a second sub-scan mode in which a maximum sub-scan feed increment is less than a maximum sub-scan feed increment of the first sub-scan mode, and dots are formed along the main scan lines in the color area in the vicinity of the border with the monochromatic area;

(c) a upper-edge monochromatic mode program for causing the computer to execute upper-edge monochromatic mode printing whereby sub-scans are performed in a third sub-scan mode, and dots are formed along the main scan lines in the monochromatic area in the vicinity of a border with the color area; and (d) a regular monochromatic mode program for causing the computer to execute regular monochromatic mode printing whereby sub-scans are performed in a fourth sub-scan mode in which a maximum sub-scan feed increment is greater than a maximum sub-scan feed increment of the third sub-scan mode, and dots are formed along the main scan lines in the monochromatic area.

* * * * *